US012145049B2

(12) United States Patent
Young

(10) Patent No.: US 12,145,049 B2
(45) Date of Patent: Nov. 19, 2024

(54) BALL GLOVE WITH BALL CATCH

(71) Applicant: Wilson Sporting Goods Co., Chicago, IL (US)

(72) Inventor: Jeremy J. Young, Gladstone, MI (US)

(73) Assignee: Wilson Sporting Goods Co., Chicago, IL (US)

( * ) Notice: Subject to any disclaimer, the term of this patent is extended or adjusted under 35 U.S.C. 154(b) by 229 days.

(21) Appl. No.: 17/396,180

(22) Filed: Aug. 6, 2021

(65) Prior Publication Data

US 2023/0043758 A1 Feb. 9, 2023

(51) Int. Cl.
*A63B 71/14* (2006.01)
*A63B 69/00* (2006.01)
*A63B 102/18* (2015.01)

(52) U.S. Cl.
CPC ..... *A63B 71/143* (2013.01); *A63B 69/0002* (2013.01); *A63B 2069/0011* (2013.01); *A63B 2102/18* (2015.10)

(58) Field of Classification Search
CPC ..... A63B 71/143; A63B 2069/0011; A63B 71/148; A63B 71/146; A41D 19/01582; A41D 19/0037
USPC ..... 2/19, 161.1
See application file for complete search history.

(56) References Cited

U.S. PATENT DOCUMENTS 2,231,204 A 2/1941 Turner
2,255,726 A 9/1941 Turner
2,558,544 A 6/1951 Delsalle
2,700,159 A * 1/1955 Denburgh ..... A63B 71/146 473/59
3,042,929 A 7/1962 Casimir
3,918,097 A * 11/1975 Mlodoch ..... A63B 71/146 2/161.1
3,994,024 A 11/1976 Bates
4,541,126 A 9/1985 Howard et al.
4,817,209 A * 4/1989 Lehmann ..... A63B 71/143 2/910
5,659,897 A 8/1997 Satoh et al.
5,694,642 A 12/1997 Rector et al.
6,182,289 B1 2/2001 Brown
6,249,915 B1 6/2001 Hang
6,412,113 B1 7/2002 Guenther et al.
6,553,571 B1 4/2003 Guenther et al.
6,571,394 B1 6/2003 Hackett et al.
6,634,029 B1 10/2003 Sullivano et al.
6,681,401 B1 1/2004 Marino
6,711,745 B2 3/2004 Sullivano et al.
6,766,531 B2 7/2004 Sullivano et al.
7,013,486 B1 3/2006 Sullivano et al.
7,111,326 B1 9/2006 Sullivano et al.
D583,105 S 12/2008 Udelhofen et al.
D583,106 S 12/2008 Udelhofen et al.
8,771,114 B2 7/2014 Markovich et al.
9,308,426 B2 4/2016 Thurman
9,375,621 B2 6/2016 Thurman
9,457,251 B2 10/2016 Thurman
(Continued)

*Primary Examiner* — Sally Haden
*Assistant Examiner* — Grady Alexander Nunnery
(74) *Attorney, Agent, or Firm* — Terence P. O'Brien; Todd A. Rathe

(57) ABSTRACT

An example ball glove ball catch system includes a ball glove and a ball catch. The ball glove may comprise webbing and a hand opening. The ball catch may be located between the hand opening and the webbing.

15 Claims, 9 Drawing Sheets

(56) References Cited

U.S. PATENT DOCUMENTS

| | | | | |
|---|---|---|---|---|
| 10,368,596 | B2 | 8/2019 | Aso | |
| 10,549,165 | B2 | 2/2020 | Thurman | |
| 2007/0220650 | A1 | 9/2007 | Aoki et al. | |
| 2014/0135150 | A1 | 5/2014 | Thurman et al. | |
| 2014/0274486 | A1 | 9/2014 | Thurman | |
| 2014/0274487 | A1 | 9/2014 | Thurman | |
| 2014/0277634 | A1 | 9/2014 | Thurman | |
| 2014/0277635 | A1 | 9/2014 | Thurman | |
| 2014/0277636 | A1 | 9/2014 | Thurman | |
| 2017/0144055 | A1 | 5/2017 | Asp | |
| 2018/0263320 | A1* | 9/2018 | Rodriguez | A41D 13/082 |

* cited by examiner

BALL GLOVE WITH BALL CATCH

BACKGROUND

Ball gloves for use in baseball, softball and other sports are well-known. Ball gloves typically include a front panel connected to a corresponding back panel to form a hand cavity. The front and back panels typically generally resemble the shape of a human hand and when assembled form five stalls for receiving the thumb and fingers of a user's hand. The front and back panels form a hand opening at the lower edge of the glove. A webbing is typically connected between the thumb stall and the index finger stall of the ball glove. Ball gloves also typically include a hand opening for enabling a user to insert his or her hand into the hand cavity of the ball glove, and, often, an index finger hole for enabling the user's index finger to rest on the back portion of the index finger stall during use. Many existing ball gloves are formed of high quality, relatively expensive materials, such as natural leather, synthetic leather, and combinations thereof.

Ball gloves are generally constructed of highly durable materials to withstand the repeated impact of fielded balls during play and the scrapes and other contact with the playing field and other objects during play. Also, ball gloves are generally sized to be much larger than the hand of the ball player. The increased size is desirable in that it provides a larger pocket, or catching area for receiving a ball during play, enabling a player to reach more balls in play than would otherwise be possible with a glove matching the size of a player's hand. The size of a ball glove also typically varies by position. An outfielder's ball glove is typically larger than infielder's ball glove, and a first baseman's ball glove is typically larger than an outfielder's glove.

Figure 1:
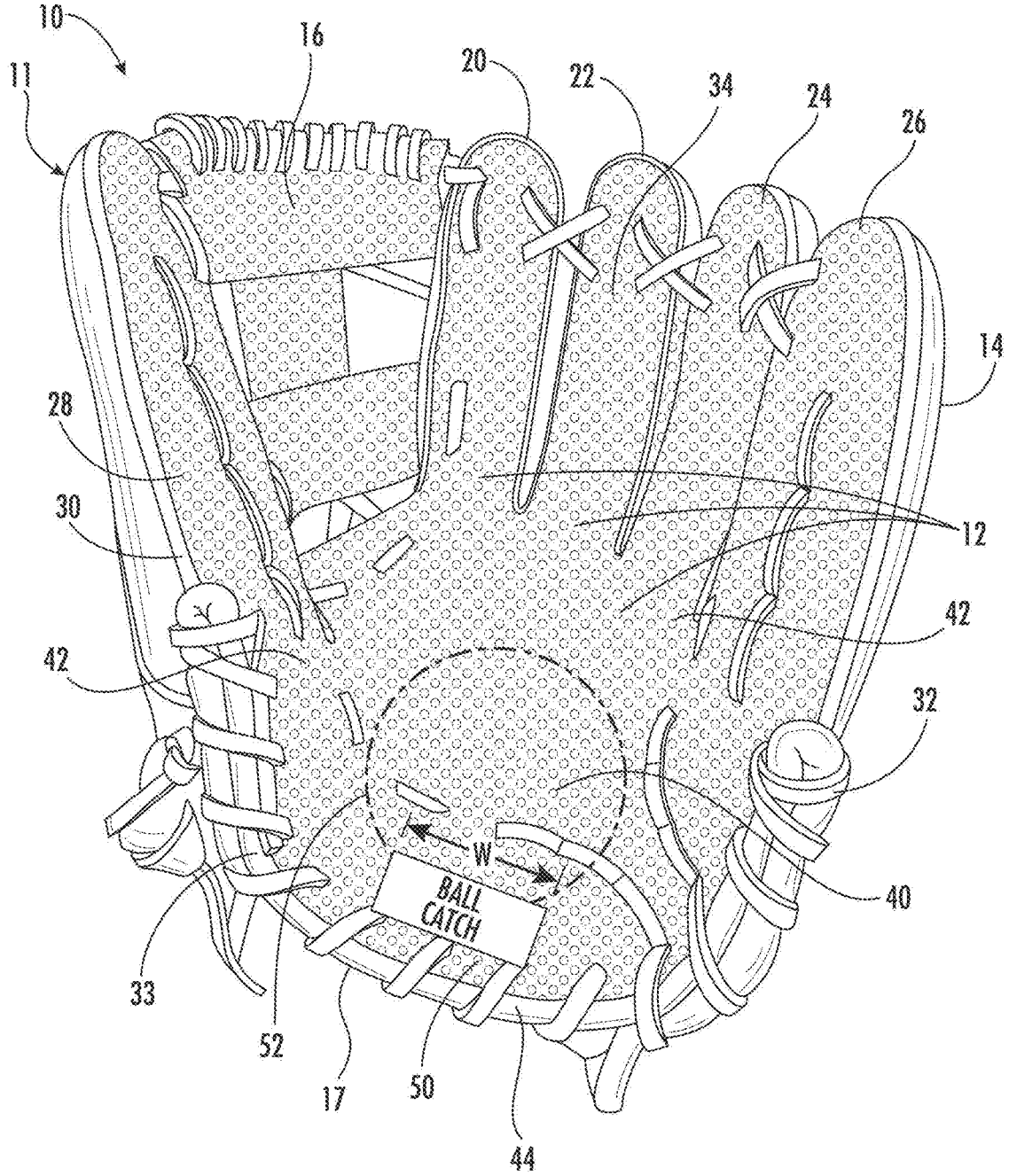
FIG. 1 is a front perspective view of an example ball glove ball catch system.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

When catching a ball (baseball, softball, or the like), a player typically squeezes the glove about the caught ball to retain the ball within the glove until the ball can be retrieved by the player's other hand. Newer gloves must often be broken in to soften the material of the glove such that the glove may be more easily and quickly squeezed about a caught ball. Some players, typically younger players, may encounter difficulties when attempting to squeeze a glove (e.g., a newer glove or a non-broken in glove) about a caught ball. Indeed, a newer unbroken-in glove can be difficult to squeeze for players of all ages.

Disclosed are example ball gloves additionally equipped with a ball catch to form a ball glove ball catch system. The example ball gloves with ball catches assist a player in retaining the ball within the glove until the player's other hand may retrieve the ball from the glove. The example ball catches may be especially beneficial for use with newer gloves that have yet to be broken in or for use by younger players whose limited hand strength may make it difficult to quickly, or adequately, squeeze the glove about a caught ball for temporary retention of the ball.

The example ball catches may project from a front face of the glove to engage a ball received within the glove to inhibit movement of the ball downwardly beyond the heel of the glove, and out of the glove. In some implementations, the example ball catches are located to retain at least a portion of a received ball within what is known as the pocket of the glove. In some implementations, the example ball catches are located between a hand opening of the glove and the webbing of the glove. In some implementations, the example ball catches are located between a heel and the webbing of the glove.

In some implementations, the example ball catches have a length sufficiently short and spaced from the opposite internal sides of the ball glove so as to not interfere with squeezing of the opposite internal sides of the ball glove towards one another as a glove squeezed about a caught ball. In some implementations, the example ball catches are flexible and/or collapsible such that the ball catches do not inhibit squeezing of the glove or the breaking in of a new glove.

In some implementations, the example ball catches are configured to be repositioned between an active position, in which the example ball catches may engage a ball received by the glove, and an inactive position, in which the example ball catches no longer positioned to engage a received ball. For example, in some implementations, the example ball catches may be repositioned on a backside of the glove or into an interior of the glove. In some implementations, the example ball catches may be moved between the active position and the inactive position while remaining connected to the glove. In some implementations, the example ball catches are releasable, removable, or separable from the glove. In such implementations, the example ball catches may be separated from the ball glove after a newer glove has been broken in or when the glove is being used by a player having sufficient hand strength to squeeze the glove about a received ball.

In some implementations, the example ball catches may pivot between the active and inactive positions. In some implementations, the example ball catches may be slidable relative to the glove, sliding between the inactive and active positions.

In some implementations, the example ball catches are elastic or resiliently movable or flexible such that the ball catches may stretch or move to facilitate withdrawal of a received ball from the glove. For example, in some implementations, an example ball catch may comprise an elastic band. In some implementations, the example ball catches are perforate to facilitate viewing of the ball engaged by the example ball catches. For example, in some implementations, an example ball catch may comprise a netting. In some implementations, the ball catch may be pleated, folded, inter-nested, telescoped, expandably stacked, expandably layered or otherwise expandably constructed.

In some implementations, the example ball catches may comprise a band spanning from the thumb stall to the end-most fingerstall (e.g., the pinky finger stall) along or above the heel of the glove. In some implementations, the example ball catches may comprise a single or multiple individual bands, strings or cords spanning from the thumb stall to the end-most fingerstall along or above the heel of the glove. In some implementations, one or both ends of each band, string or cord may be releasably coupled, releasably mounted or releasably connectable to the glove. In some implementations, one or both ends of each band, string or cord may be releasably mounted to the glove. Such bands, strings or cords may be mounted by various connection mechanisms such as hook and loop fasteners, buckles, snap fit connectors, buttons, zippers, and the like.

In some implementations, the example ball catches may be added to an existing ball glove by being mounted to an existing ball glove. Such mounting may be permanent or releasable. In some implementations, the example ball catch may be provided as part of the kit having glove connectors and a ball catch, wherein the glove connectors are to be affixed to a glove and wherein the ball catch has corresponding catch connectors that interact with the glove connectors to secure the ball catch to the glove. For example, such a kit may include a first portion of a hook and loop fastening system, the first portion of a snap connector or the like which are provided with an adhesive for securement to an existing glove. Such a kit may further include a ball catch having a second portion of the hook and loop fastening system, the second portion of a snap connector or the like. With such kits, existing or aftermarket gloves may be modified for use with the example ball catches.

Disclosed is an example ball glove ball catch system comprises a ball glove and a ball catch. The ball glove may comprise a webbing and a hand opening. The ball catch may be located between the hand opening and the front pocket, or between the hand opening and the webbing.

Disclosed an example ball catch for use with a ball glove. The example ball catch may comprise a band having a length so as to span between a thumb stall and a distant finger stall along a heel of the glove of a front side of the glove, a first connector on a first end portion of the band for releasable connection of the band to the glove, and a second connector on a second end portion of the band for releasable connection of the band to the glove.

Disclosed is an example ball glove for use with a ball catch. The ball glove may comprise a front side having a pocket, a thumb stall, at least one fingerstall, a hand opening, and a heel between the hand opening and the pocket, and a back side having a first connector for releasable connection to a first end portion of the ball catch and a second connector for releasable connection to a second end portion of the ball catch to retain the ball catch in an active position in which the ball catch projects along the front side of the glove between the hand opening and the pocket, or between the hand opening a webbing coupled to the front side.

FIG. 1 illustrates an example ball glove catch system 10. Ball glove ball catch system 10 assists in retaining a ball within a ball glove until a ballplayer can retrieve the ball from the glove with his or her other hand. Ball glove ball catch system 10 comprises ball glove 11 and ball catch 50.

The ball glove 11 is configured for use in baseball, softball and other sports involving ball gloves. For purposes of this disclosure, the phrase "configured to" denotes an actual state of configuration that fundamentally ties the stated function/use to the physical characteristics of the feature proceeding the phrase "configured to". The ball glove 11 can also be referred to as a mitt. Although ball glove 11 is illustrated as an outfielder glove, ball glove 11 may have other configurations specialized for other positions. For example, ball glove 11 may have other configurations such as where ball glove 11 comprises an infielder glove, a pitcher's glove, a first baseman's glove or a catcher's mitt. The ball glove 11 includes a front glove portion 12, a back glove portion 14 and a webbing 16.

The front and back portions 12 and 14, respectively, are contoured sheet-like structures, each generally resembling a hand. The front portion 12 is coupled to the back portion 14. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. The use of the term "coupled" can be interpreted in a manner similar to its use with railroad cars. A train engine can be directly connected to a caboose, or one, two, ten or any number of train cars can be linked between the engine and the caboose of a train. In both of these examples whether directly connected or indirectly linked by one or more train cars, the train engine is coupled to the caboose.

Such coupling may be permanent in nature or alternatively may be removable or releasable in nature. For purposes of this disclosure, the term "releasably" or "removably" with respect to an attachment or coupling of two structures means that the two structures may be repeatedly connected and disconnected to and from one another without material damage to either of the two structures or their functioning.

The front and back portions 12 and 14 are connected together to define a hand opening 17, serving as a mouth to a hand cavity, and to form first, second, third and fourth finger stalls 20, 22, 24, 26, and a thumb stall 28. Each of finger and thumb stall 20-28 defines an elongate cavity for receiving the respective finger or thumb of the user. The front and back portions 12 and 14 may be stitched together. In one example implementation, the front and back portions 12 and 14 are coupled together through the use of weltings 30 and/or bindings. Alternatively, the front and back portions 12 and 14 can be connected through other means, such as, for example, lacings 32, stitchings, bonding, molding or adhesives and combinations thereof.

In some implementations, a binding 33 can be used at one or more edges of the front and/or back portions 12 and 14. The binding 33 generally wraps around and covers the edges of the front and back portions. The binding 33 can be stitched to one or more pieces of the front and/or back portions 12 and 14. Alternatively, the binding 33 can be coupled to the front and back stall portions through adhesives, stapling or other conventional fastening means. The binding 33 may be formed of a generally flexible, durable material, such as leather. Alternatively, the binding 33 may be formed of other materials, such as, for example, synthetic leather, plastic, other polymeric materials, composite materials, rubber, and combinations thereof. The binding 33 can be formed of one or more colors or textures, which can match or differ from the color and texture of the front and back portions 12 and 14. The binding 33 can also be formed to be stiffer and/or harder than the material forming the front and back portions to further strengthen or stiffen particular regions of the ball glove 11. The binding can be formed of one or more pieces or layers.

The front portion 12 covers and protects the palm-side of the user's hand from impact with the ball. The front portion 12 forms what is known as a front pocket or pocket 40 which generally extends between a base 42 of each of the finger and thumb stalls 20-28 and the heel 44 of ball glove 11. Heel 44 borders the mouth or hand opening 17.

The back portion 14 supports the front portion 12 and extends over, and can protect, the backside of the user's hand. The front and back portions 12 and 14 are made of a pliable, durable, and relatively soft material, such as leather. In alternative implementations, the front and back portions 12 and 14 can be made of other materials, such as, for example, artificial leather, composite leather, rubber, plastic, polyurethanes, other polymers, and combinations thereof.

The webbing 16 is a generally flat structure that is connected, and in some implementations, stitched and/or laced, to the front and back portions 12 and 14 between the first finger stall 20 and the thumb stall 28. The webbing 16 provides the ball glove 11 with a large catching surface for cradling a ball that is caught. The webbing 16 also provides the ball glove 11 with a surface for absorbing the initial impact of a ball being caught, reducing impacts directly to the player's hand within the glove. In some implementations, the webbing 16 can be formed by one or more pieces of durable flexible material that can include openings that are smaller than the size of the ball. In other limitations, the webbing can be a continuous panel formed of one or more pieces of flexible material without openings.

The finger stalls 20-26 and the thumb stall 28 are elongate cavities adapted for receiving the fingers and thumb of the user. Each finger stall 20-26 and thumb stall 28 includes a front stall portion 34 of the front portion 12 and a back stall portion 36 of the rear portion 14. The front and back stall portions 34 and 36 are coupled to each other, such as through the plurality of weltings 30, lacings 32 and stitchings. Alternatively, the front and back stall portions 34 and 36 can be connected through other means, such as, for example, stitching only, bonding, other fasteners, or molding. In order to facilitate the fielding of balls during play, the ball glove 11 is typically larger than the hand of the user. In particular, the finger and thumb stalls 20-28 may be significantly longer than the length needed to accommodate the user's fingers and thumb. In other implementations, the ball glove may include two or three finger stalls in which a single finger stall may be configured to receive one, two or three fingers of the player.

Ball catch 50 is schematically illustrated in FIG. 1. As will be described hereafter with respect to other figures, ball catch 50 may have a variety of different configurations such as a variety of sizes and shapes as well as a variety of different material characteristics. Ball catch 50 is located between hand opening 17 and the base of the finger stalls 20-26, or between the opening 17 and the webbing 16. In the example illustrated, ball catch 50 is located at least in part between heel 44 and front pocket 40, or between the heel 44 and the webbing 16 or between the heel 44 and the finger stalls 20-26. Ball catch 50 comprises a structure projecting or extending from the front face or front surface in front portion 12 by a distance so as to have a height sufficient for catching against a ball 52 (shown in broken lines) received within ball glove 11 and retain the ball within the pocket 40. Ball catch 50 inhibits ball 52 from rolling completely out of pocket 40, below heel 44 and out of the glove 11, when ball glove 11 is in a generally vertical orientation or in a fielding position. Ball catch 50 may retain at least a portion of ball 52 within pocket 40 until it is withdrawn by the player's other hand. In one implementation, ball catch 50 has a height of at least 25% of a diameter of the ball 52. In another implementation, the ball catch 50 has a height of at least 50% of the diameter of the ball 52. In some implementation, ball catch 50 has a height of at least 1 inch. The height of the ball catch 50 does not have to be defined by continuous material or structure, but rather the distance from the bottom of the heel 44 to the top of the ball catch 50 (for example, item H in FIG. 7). In another implementation, the ball catch 50 has a height within the range of 1 to 6 inches. In another implementation, the ball catch 50 has a height within the range of 1.5 to 4 inches.

In some implementations, ball catch 50 is flexible and/or collapsible such that ball catch 50 does not inhibit squeezing of the glove 11 or the breaking in of a new glove 11. In some implementations, ball catch 50 is centrally located and has a width W less than the diameter of ball 52 such that interior portions of glove 11 do not contact the side edges of ball catch 50 when ball glove 11 is being squeezed against or about ball 52. In such implementations, ball catch 50 is less likely to interfere with the squeezing of glove against or about ball 52. In some implementations, ball catch 50 has a width of at least 2 inches. In one implementation, the ball catch 50 has a width within the range 2 to 12 inches. In another implementation, the ball catch 50 has a width within the range of 3 to 8 inches.

In some implementations, ball catch 50 may be rigid in nature or inflexible, wherein ball catch 50 also has a width sufficiently small to not interfere with squeezing of glove 11 about ball 52. In some implementations, ball catch 50 is additionally sufficiently wide such that any spaces between the outermost ends of ball catch 50 and the interior sides of ball glove 11 are smaller than the diameter of ball 52. As a result, ball 52 may not inadvertently slip past ball catch 50 between an end of ball catch 50 and an interior side of ball glove 11. In some implementations, ball catch 50 has a width such that the spacing between either end of ball catch 50 and the interior sides of the ball glove 11 is no greater than 2 inches. In many implementations, the ball catch 50 is coupled to the ball glove such that it does not inhibit the squeezing or closing of the ball glove by the player.

In some implementations, ball catch 50 is configured to be repositioned between an active position in which ball catch 50 may engage a ball 52 received by the glove 11 and an inactive position in which ball catch 50 does not, or no longer, engage(s) the received ball 52. For example, in some implementations, ball catch 50 may be repositioned on a backside of the glove 11 or into an interior of the glove 11. In some implementations, ball catch 50 may be moved between the active position and the inactive position while remaining connected to the glove 11. In some implementations, ball catch 50 is releasable, removable, or separable from the glove 11. In such implementations, ball catch 50 may be separated from the ball glove 11 after ball glove 11 has been broken in or when the glove 11 is being used by a player having sufficient hand strength to squeeze the glove 11 about a received ball 52.

In some implementations, ball catch 50 may pivot between the active and inactive positions. In some implementations, ball catch 50 may be slidable relative to the glove 11, sliding between the inactive and active positions. In some limitations, ball catch 50 may expand, elongate or unfold relative to the glove between the inactive and active positions.

In some implementations, ball catch 50 is elastic or resiliently movable or flexible such that the ball catches may stretch or move and may facilitate withdrawal of a received ball from the glove. For example, in some implementations, ball catch 50 is may comprise an elastic band. In some implementations, ball catch 50 is perforate to facilitate viewing of the ball engaged by the example ball catches. For example, in some implementations, ball catch 50 may comprise a netting.

In some implementations, ball catch 50 may comprise a band spanning from the thumb stall 28 to the end most fingerstall 26 (e.g. the pinky finger stall 26) along or above the heel of the glove. In some implementations, ball catch 50 may comprise a single or multiple individual bands, strings or cords spanning from the thumb stall 28 to the end most finger stall 26 along or above the heel of the glove. In some implementations, one or both ends of each band, string or cord may be releasably mounted or connectable to the glove. In some implementations, ball catch 50 may be pleated, stacked or layered so as to be adjustably expandable across the heel of the glove. In some implementations, one or both ends of each band, string or cord may be releasably mounted to the glove. Such bands, strings or cords may be mounted by various connection mechanisms such as hook and loop fasteners, buckles, snap fit connectors, buttons, zippers, and the like.

In some implementations, ball catch 50 may be added to an existing ball glove by being mounted to an existing ball glove. Such mounting may be permanent or releasable. In some implementations, ball catch 50 may be provided as part of the kit having glove connectors and a ball catch, wherein the glove connectors are to be affixed to a glove and wherein the ball catch has corresponding catch connectors that interact with the glove connectors to secure the ball catch to the glove. For example, such a kit may include a first portion of a hook and loop fastening system, the first portion of a snap connector or the like which are provided with an adhesive for securement to an existing glove 11. Such a kit may further include a ball catch 50 having a second portion of the hook and loop fastening system, the second portion of a snap connector or the like. With such kits, existing or aftermarket gloves may be modified for use with ball catch 50.

Figure 2:
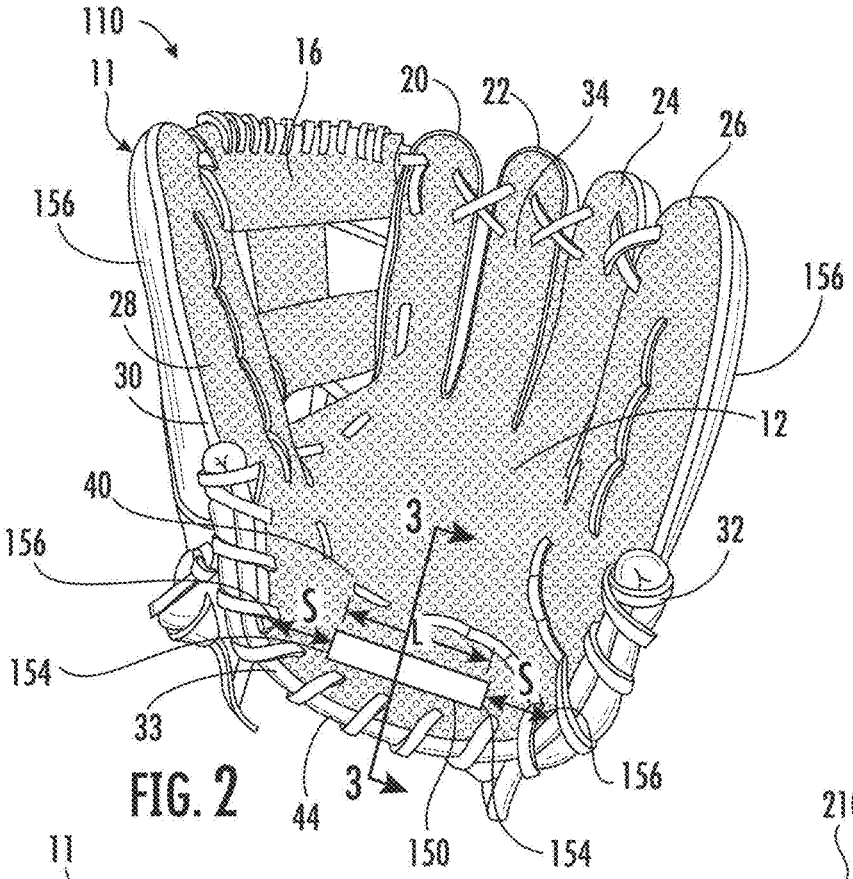
FIG. 2 is a front perspective view of an example ball glove ball catch system.
Figure 3:
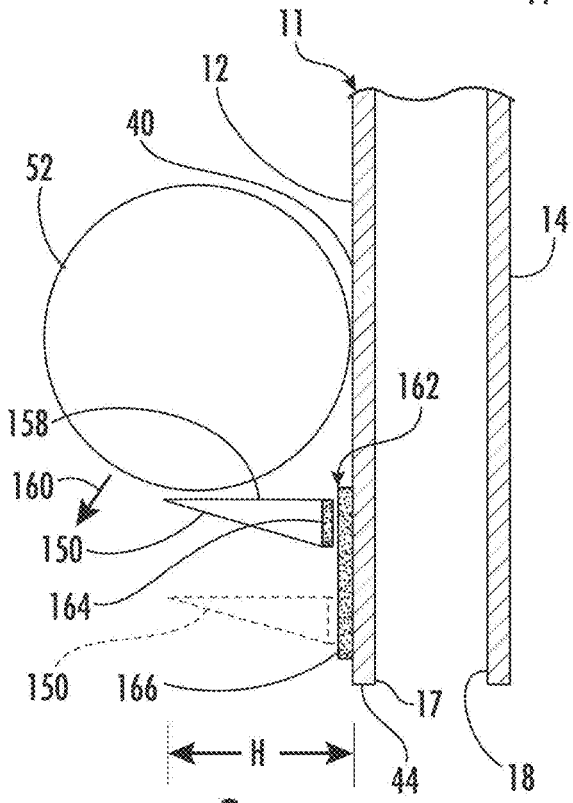
FIG. 3 is a fragmentary sectional view of the example ball glove ball catch system of FIG. 2 taken along line 3-3.

FIGS. 2 and 3 illustrate an example ball glove ball catch system 110. FIGS. 2 and 3 illustrate an example ball catch and how the example ball catch may be mounted to ball glove 11. As shown by FIG. 2, ball catch 150 can rise up from or project from front portion 12 between heel 44 and pocket 40, or between the heel 44 and the webbing 16. Ball catch 150 can have outer ends 154 which are each spaced from sides 156 of glove 11 by a spacing S that is less than the diameter of the baseball or softball to be caught by glove 11. Although not necessarily equal, in one implementation, each of spacings S is no greater than 2 inches. In other implementations, the ball catch 150 may fully extend from the thumb stall 28 to the pinky finger stall 26 side of the ball glove 11.

In one implementation, ball catch 150 is formed from a rigid or non-bendable material and has a length L sufficiently short so as to not interfere with the squeezing of sides 156 towards and about ball 52 (shown in FIG. 3). In yet other implementations, ball catch 150 may be formed from a flexible, bendable material.

FIG. 3 is a sectional view of ball glove 11 taken along line 3-3 of FIG. 2. As shown by FIG. 3, ball catch 150 has a height H sufficient to attain ball 52 when ball glove 11 is in a substantially vertical orientation. In one implementation, ball catch 150 has a height H greater than or equal to one half the diameter of ball 52. In one implementation, ball catch 150 has a height H of at least 1 inch. In other implementations, the height H of FIG. 3 can be at least 1.5 inches. In the example illustrated, ball catch 150 is illustrated as having a three-sided, triangular shape with a ball catching wall 158 that forms a right angle with the surface of ball glove 11 from which ball catch 150 extends. In some implementations, wall 158 may form an acute angle with the surface of ball glove 11 from which ball catch 150 extends. In yet other implementations, ball catch 150 may have other shapes.

In some implementations, the surface of wall 158 is formed from a material or has a surface geometry to facilitate gripping of ball 52 and to inhibit inadvertent dislodgement of ball 52. For example, the surface of wall 158 may be formed from a material having a high coefficient of friction with ball 52 and/or may be provided with dimples, grooves, serrations or the like to grip ball 52. In some implementations, wall 58 may have a rubber or rubber-like surface. In some implementations, the wall 158 is highly flexible or soft for facilitating the receipt and retention of the ball 52.

In one implementation, ball catch 150 is sufficiently rigid so as to not bend or deform under the weight of ball 52 resting against ball catch 150, wherein ball catch 150 is sufficiently bendable such that a person moving ball 52 against ball catch 150 with his or her hand will resiliently band ball catch 150 away from pocket 40. As a result, ball catch 150 facilitates easier removal of ball 52 out of pocket 40 in a direction towards heel 44 (as indicated by arrow 160) as ball catch 150 bends away from pocket 40. In implementations where ball catch 150 is formed from a bendable or flexible material, ball catch 150 may be provided with a longer length or a length completely spanning between sides 156, wherein ball catch 150 deforms or bends during the squeezing of sides 156 about a received ball 52. Examples of bendable or flexible materials from which ball catch 150 may be formed include, but are not limited to, a leather, a synthetic leather, a nylon, a plastic, a rubber, a polyurethane, other polymeric materials and combinations thereof. Examples of rigid or bendable materials from which ball catch 150 may be formed include, but are not limited to, leather, synthetic leather, plastic, rubber, wood, metallic alloys, polymeric materials, and combinations thereof.

As further shown by FIG. 3, in the example illustrated, ball catch 150 is removably mounted to front portion 12 of ball glove 11 by connector 162. As a result, ball catch 150 may be selectively mounted to or dismounted from ball glove 11. For example, once ball glove 11 has been sufficiently broken in, ball catch 150 may be removed and no longer used. In circumstances where ball glove 11 is used by a player having sufficient hand strength to squeeze glove 11 about a received ball 52, ball catch 150 may be removed and no longer used. Alternatively, when ball glove 11 is being used by younger player lacking sufficient hand strength to squeeze glove 11 about a ball 52, ball catch 150 may be added to glove 11.

In the example illustrated, connector 162 comprises a hook and loop fastener arrangement (sometimes referred to as VELCRO™). In such an example, connector 152 comprises a first portion 164 of a hook and loop fastener arrangement carried by ball catch 150 and a second portion 166 of the hook and loop fastener arrangement carried by front portion 12 of glove 11. In the example illustrated, the second portion 166 has an area greater than the thickness of first portion 164 and of ball catch 150. As shown by broken lines, connector 162 facilitate selective mounting of ball catch 150 at a continuum of different locations along front portion 12 of ball glove 11 relative to pocket 40. As a result, a player may selectively position ball catch 150 closer to or farther away from pocket 40 depending upon his or her preferences and/or whether glove 11 is being used to catch a softball or a baseball. In some implementations, second portion 166 may be backed with an adhesive, wherein ball catch 150 and second portion 166 may be provided as a kit and wherein second portion 166 may be adhered to in existing glove, facilitating an aftermarket modification of glove 11. In yet other implementations, second portion 166 may be stitched, sewn, bonded, welded or otherwise joined to ball glove 11.

In yet other implementations, connector 162 may comprise other mechanisms for releasably mounting ball catch 150 to ball glove 11. For example, connector 162 may alternatively comprise a snapping mechanism, a hook, a button, a buckle, or the like. In still other implementations, ball catch 150 (without first portion 164) may be permanently secured to glove 11 with stitches, adhesives, welds, rivets, lacing, and the like.

Figure 4:
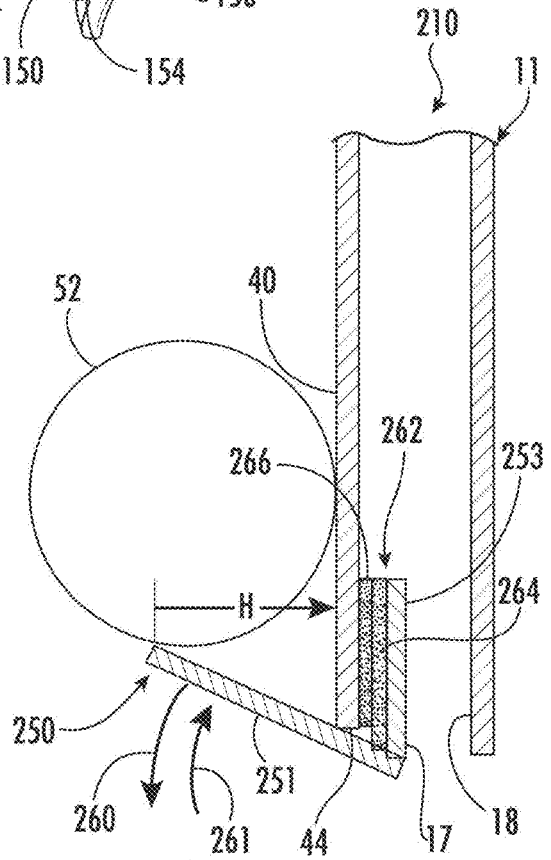
FIG. 4 is a fragmentary sectional view of an example ball glove ball catch system.

FIG. 4 is a sectional view of portions of an example ball glove ball catch system 210. FIG. 4 illustrates an example of how a ball catch may be mounted within a hand cavity 18 and may project from hand opening 17 for engaging a ball caught by glove 11. System 210 is similar to system 110 except that system 210 comprises ball catch 250 in lieu of ball catch 150. The remaining components of system 210 which correspond to components of system 110 are shown in FIG. 2 and/or are shown in FIG. 4 and numbered similarly.

Ball catch 250 comprises a projecting portion 251 comprising a flap or finger projecting from a mounting portion 253 received within hand cavity 18. Projecting portion extends about the edge of heel 44 to a height H sufficient to retain a caught ball 52 when glove 11 is in a vertical orientation. In one implementation, ball catch 250 has a height H greater than or equal to one half the diameter of ball 52. In one implementation, ball catch 250 has a height H of at least 1 inch. In other implementations, the height H of the ball catch 250 of FIG. 4 can be at least 1.5 inches.

In one implementation, ball catch 250 is sufficiently rigid so as to not bend or deform under the weight of ball 52 resting against ball catch 250, wherein ball catch 250 is sufficiently bendable such that a person moving ball 52 against ball catch 250 with his or her hand will resiliently bend ball catch 150 away from pocket 40. As a result, ball catch 250 facilitates easier removal of ball 52 out of pocket 40 in a direction away from heel 44 (as indicated by arrow 260) as ball catch 150 bends away from pocket 40. As indicated by arrow 261, ball catch 250 resiliently returns to a default catch position following withdrawal of ball 52. In implementations where ball catch 150 is formed from a bendable or flexible material, ball catch 150 may be provided with a longer length or a length completely spanning between sides 156, wherein ball catch 250 deforms or bends during the squeezing of sides 156 about a received ball 52. Examples of bendable or flexible materials from which ball catch 250 may be formed include, but are not limited to, a leather, a synthetic leather, a nylon, a plastic, a rubber, a polyurethane, other polymeric materials and combinations thereof. Examples of rigid or bendable materials from which ball catch 250 may be formed include, but are not limited to, leather, synthetic leather, plastic, rubber, wood, metallic alloys, polymeric materials, and combinations thereof.

As further shown by FIG. 4, in the example illustrated, ball catch 250 is removably mounted to ball glove 11 by connector 262. As a result, ball catch 250 may be selectively mounted to or dismounted from ball glove 11. For example, once ball glove 11 has been sufficiently broken in, ball catch 250 may be removed and no longer used. In circumstances where ball glove 11 is used by a player having sufficient hand strength to squeeze glove 11 about a received ball 52, ball catch 250 may be removed and no longer used. Alternatively, when ball glove 11 is being used by younger player lacking sufficient hand strength to squeeze glove 11 about a ball 52, ball catch 250 may be added to glove 11.

In the example illustrated, connector 262 comprises a hook and loop fastener arrangement (sometimes referred to as VELCRO™). In such an example, connector 262 comprises a first portion 264 of a hook and loop fastener arrangement carried by ball catch 250 and a second portion 266 of the hook and loop fastener arrangement carried within the hand opening 17 of glove 11. In some implementations, second portion 266 may be backed with an adhesive, wherein ball catch 250 and second portion 266 may be provided as a kit and wherein second portion 266 may be adhered to in existing glove, facilitating an aftermarket modification of glove 11. In yet other implementations, second portion 266 may be stitched, sewn, bonded, welded or otherwise joined to ball glove 11.

In yet other implementations, connector 262 may comprise other mechanisms for releasably mounting ball catch 250 to ball glove 11. For example, connector 262 may alternatively comprise a snapping mechanism, a hook, a button, a buckle or the like. In still other implementations, ball catch 250 (without first portion 264) may be permanently secured to glove 11 through the use of stitches, adhesives, welds, rivets, lacing and the like.

Figure 5:
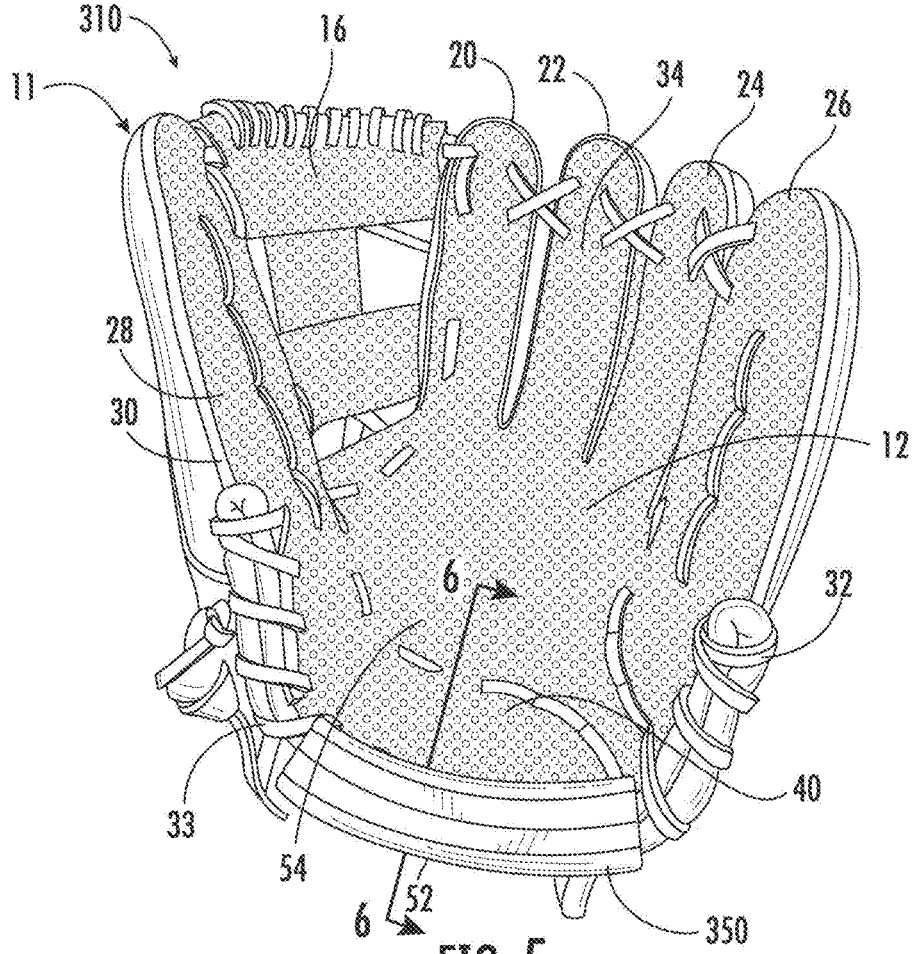
FIG. 5 is a front perspective view of an example ball glove ball catch system.
Figure 6:
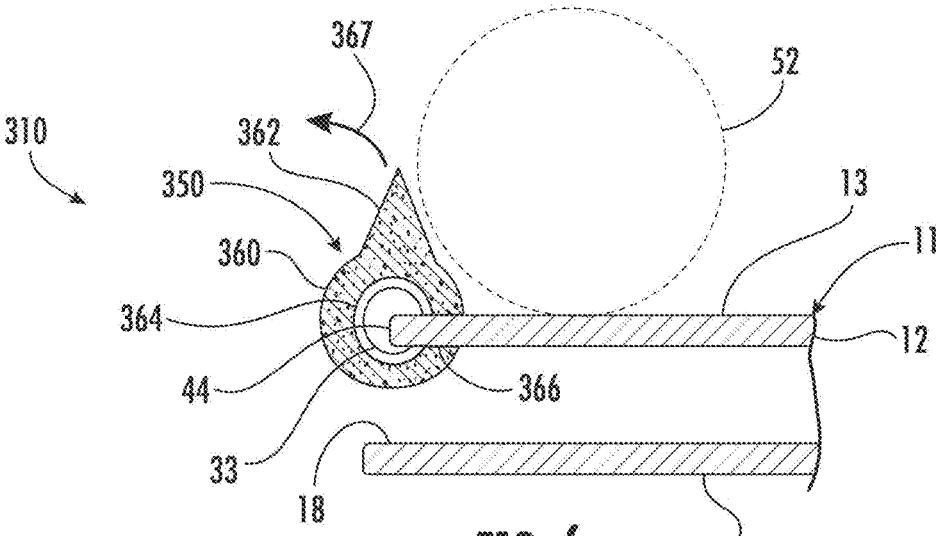
FIG. 6 is a fragmentary sectional view of the example ball glove ball catch system of FIG. 5 taken along line 6-6.

FIGS. 5 and 6 illustrate an example ball glove ball catch system 310. FIGS. 5 and 6 illustrate an example of how an example ball catch may be mounted about the heel of a ball glove. FIG. 6 is a sectional view of the system 310 of FIG. 5 taken along line 6-6 of FIG. 5. System 310 is similar to system 110 except that system 310 comprises ball catch 350 in lieu of ball catch 150. The remaining components of system 310 which correspond to components of system 110 are numbered similarly.

Ball catch 350 mounts about heel 44 of glove 11. Ball catch 350 comprises a hollow sleeve or cylinder 360 supporting a raised protuberance 362 and including a hollow interior 364 and slit 366 for receiving heel 44. As shown by FIG. 6, heel 44 passes through slit 366 into the hollow interior 364. The hollow interior 364 may further contain any bindings 33 that may extend about heel 44.

Protuberance 362 projects from cylinder 360 to abut a caught ball 52. Protuberance 362 has a height above of front portion 12 sufficient to retain ball 52 above heel 44 when glove 11 is in a vertical orientation. In some implementations, protuberance 362 has a height greater than or equal to the radius of ball 52. At the same time, the height of protuberance 362 is sufficiently small so as to not interfere with a ball being caught within pocket 40. In some implementations, protuberance 362 has a height of at least 0.5 inch and no greater than 4 inches.

In some implementations, cylinder 360 and protuberance 362 are integrally formed as a single unitary body. In some implementations, cylinder 360 and protuberance 362 are formed from a resiliently compressible material such as a polyurethane foam. In such implementations, slit 366 may be sized less than the thickness of heel 44, wherein cylinder 360 temporarily expands during insertion of heel 44 through slit 366 and then resiliently closes to grip about heel 44. In such implementations, may be removed from glove 11 by pulling ball catch 350 off of heel 44 of glove 11. In some implementations, a hook and loop fastening arrangement may be provided to further assist in retaining ball catch 350 about heel 44. For example, a hook and loop fastener may be employed between an edge of slit 366 and one or both of faces of front portion 12 adjacent to heel 44. In yet other implementations, ball catch 350 may be more permanently secured to heel 44 with adhesives along the edges of slit 366 or within interior 364.

In some implementations, cylinder 360 and/or protuberance 362 may be formed from a rigid material. For example, in one implementation, cylinder 360 may be formed from a resiliently compressible material for gripping about heel 44, wherein protuberance 362 is formed from a rigid material for supporting the weight of ball 52. In some implementations, cylinder 360 may be formed from a rigid material, wherein adhesives are used to secure cylinder 360 about heel 44 and wherein protuberance 362 is formed from a resiliently compressible material, such as a rubber, to permit protuberance 362 to resiliently bend or flex in the direction indicated by arrow 367 during withdrawal of ball 52 from glove 11.

As shown by FIG. 5, ball catch 350 extends across a majority, if not substantially all of the length of heel 44. In such an implementation, cylinder 360 and protuberance 362 are formed from a resiliently compressible material which permits glove 11 to be squeezed about ball 52. In other implementations, ball catch 350 may have a length dimension similar to ball catch 150 described above, a length sufficiently small to permit ball glove 11 to be squeezed about ball 52, even in implementations where ball catch 350 is formed from a rigid material, and sufficiently long to inhibit ball 52 from passing between the ends of ball catch 350 and the interior sides of glove 11.

Figure 7:
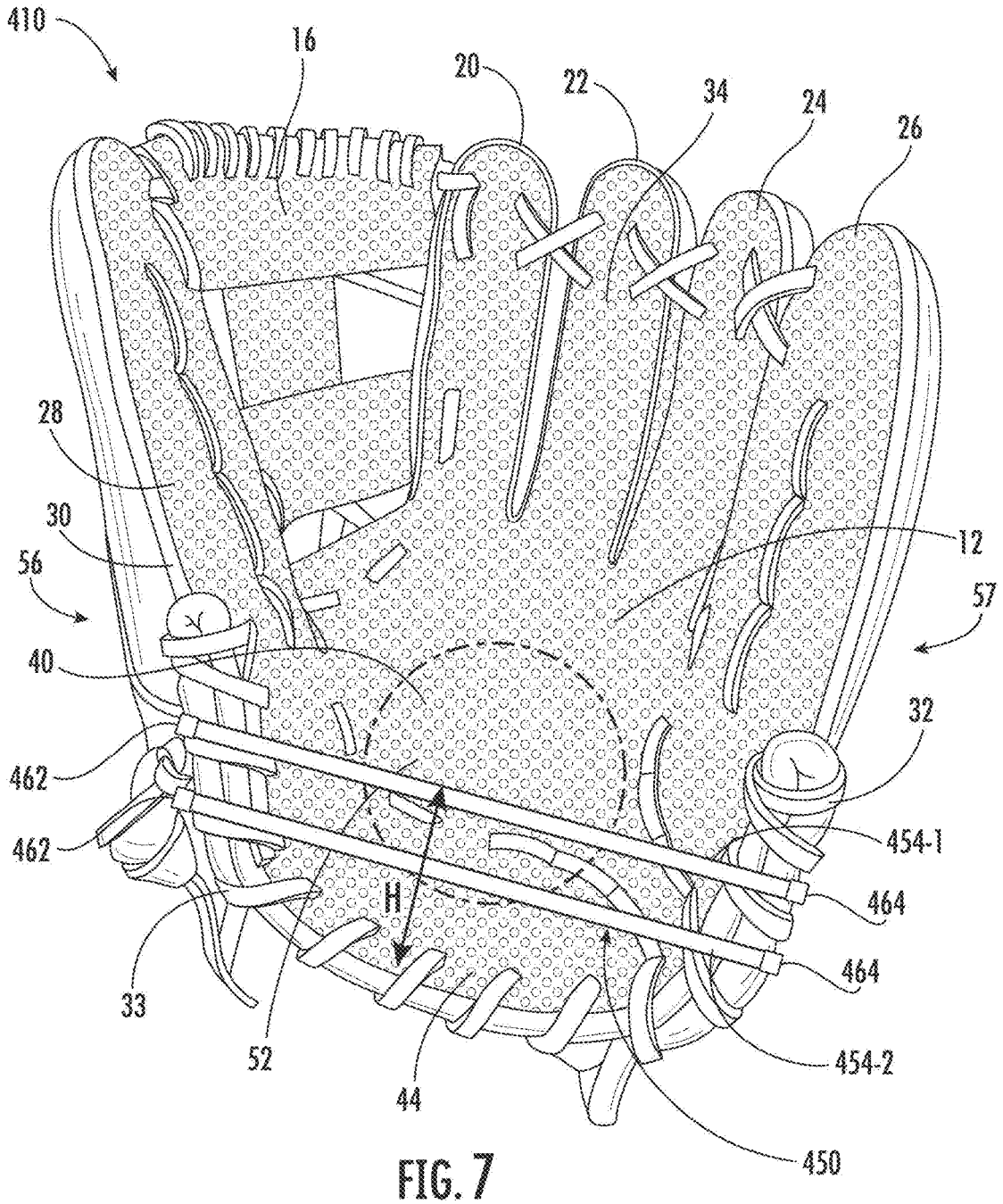
FIG. 7 is a front perspective view of an example ball glove ball catch system.

FIG. 7 illustrates an example ball glove ball catch system 410. FIG. 7 illustrates an example of an alternative ball catch formed from multiple spaced lines, bands, cords, or the like. System 410 comprises glove 11 (described above) and ball catch 450.

Ball catch 450 comprises a series of strands 454-1, 454-2 (collectively referred to as strands 454) and connectors 462, 464. Strands 454 comprise strings, cords, bands, or other lengths of material that span or stretch across the front side of glove 11 from the thumb side 56 to the pinky side 57 of glove 11. In some implementations, strands 54 are flexible or foldable, permitting the thumb side 56 and the pinky side 57 of glove 11 to be squeezed towards one another about a received ball 52. In some implementations, strands 54 are resiliently flexible so as to remain taught, at least initially, during the squeezing of the thumb side 56 and the pinky side 57 of glove 11 about the received ball 52.

The uppermost strand 454-1 is elevated above heel 44 at a height sufficient to retain a ball 52 at least partially within pocket 40 when glove 11 is in a vertical orientation. At the same time, strand 454-1 is sufficiently spaced below the finger and thumb stalls 20-28 so as to not interfere with a ball in the process of being caught by glove 11. In some implementations, strand 454-1 has a height H above heel 44 of at least 1 inch. In another implementation, the height H of the strand 454-1 of the ball catch 450 is within the range of 1 to 6 inches. In another implementation, the height H of the strand 454-1 of the ball catch 450 is within the range of 1.5 to 4 inches.

The lowermost strand 454-2 extends between strand 454-1 and heel 44. The lowermost strand 54-2 is spaced from strand 454-1. As a result, ball 452 may be viewed while being retained by ball catch 450. In some implementations, strand 454-1 and/or strand 454-2 may additionally be formed from a translucent or transparent material to further facilitate such viewing of a received ball 52. Strand 454-2 is spaced from heel 44 by distance sufficiently small such that ball 52 may not pass between strand 454-2 and heel 44. Strand 454-2 is spaced from strand 454-1 by distance sufficiently small such that ball 52 may not pass between strand 454-1 and 454-2. In some implementations, additional strands may be provided between the uppermost strand and the lowermost strand. In such implementations, the lowermost strand 454-2 may be spaced from the uppermost strand 454-1 by a greater distance. In other implementations, the ball catch 450 can include a single strand 454 or three or more strands 454.

Connectors 462 and 464 are located on opposite ends of strands 454-1 and 454-2. In some implementations, connectors 462 and 464 permanently connect the ends of strands 454 to the opposite sides of glove 11. For example, in some implementations, connectors 462 and 464 may comprise stitching, welds, adhesive or the like to join the ends of strands 454 to glove 11. In implementations where strands 454 are sufficiently resiliently flexible, strands 454 may be stretched and moved from the active position shown in FIG. 7 to an inactive position where strands 454 can stretch and/or extend along a backside of glove 11 when ball catch 450 is no longer to be used. Strands 454 may be subsequently stretched, extended and/or repositioned in the active position shown when desired.

In some implementations, connector 462 and/or connector 464 releasably connect the respective ends of strands 454 to their respective sides of glove 11. For example, in some implementations, one or both of connectors 462, 464 may comprise hook and loop fastening arrangements. In yet other implementations, one or both of connectors 462, 464 may comprise quick release buckles, snaps, hooks, buttons, or other releasable connection mechanisms. In implementations where connectors 462 and 464 both releasably connect the respective ends to glove 11, both of strands 454 may be disconnected from glove 11 when catch 450 is no longer to be used. Ball catch 450 may be remounted when desired.

In those implementations where at least some of strands 454 are completely removable or separable from glove 11, individual strands 454 may be selectively added or removed from glove 11 to accommodate differently sized balls (baseball or softball) and/or to accommodate different player preferences. Some players may prefer a larger number of strands or the topmost strand having a greater height H. Other players prefer a smaller number of strands or the topmost strand having a lower height H. In some implementations, the first portion of strands 454 may be permanently mounted by connectors to glove 11 and a second portion of the strands may be releasably or removably mounted to glove 11. In such implementations, one or both of strands 454 may be exchanged with different replacement strands formed from different materials or having different vertical widths, different colors, different elastic properties, different thicknesses, or the like.

Figure 8:
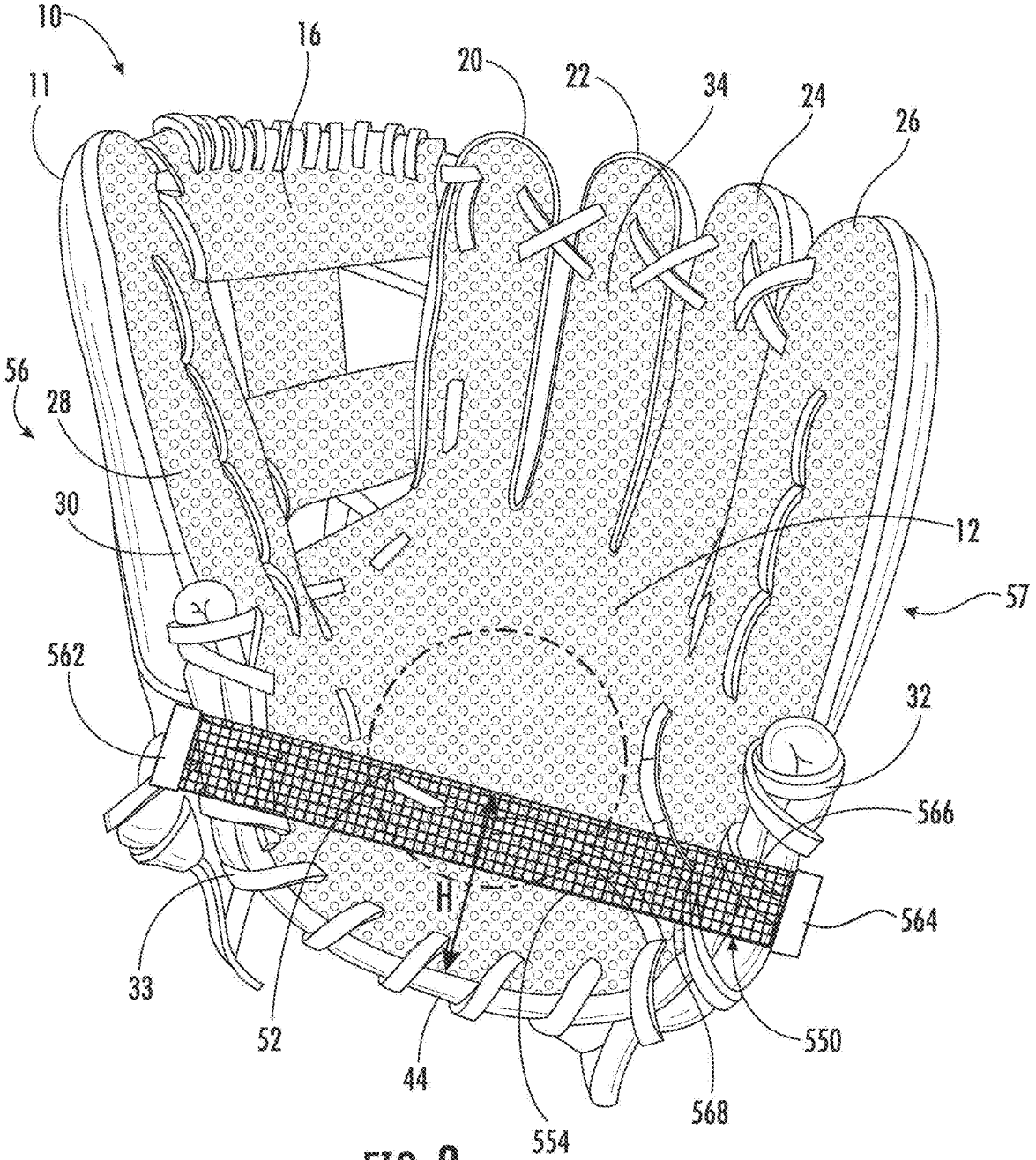
FIG. 8 is a front perspective view of an example ball glove ball catch system.

FIG. 8 illustrates an example ball glove ball catch system 510. FIG. 8 illustrates an example of a ball catch in the form of a netting. System 510 comprises ball glove 11 (described above) and ball catch 550. Ball catch 550 comprises netting 554 and connectors 562, 564.

Netting 554 comprises a perforate member that spans or stretches across the front side of glove 11 from the thumb side 56 to the pinky side 57 of glove 11. Netting 554 permits viewing of a ball retained by ball catch 550. In some implementations, netting 554 is flexible or foldable, permitting the thumb side 56 and the pinky side 57 of glove 11 to be squeezed towards one another about a received ball 52. In some implementations, netting 554 is resiliently flexible so as to remain taught during the squeezing of the thumb side 56 in the pinky side 57 of glove 11 about a received ball.

Netting 554 has a top edge 566 that is elevated above heel 44 at a height sufficient to retain a caught ball 52 at least partially within pocket 40 when glove 11 is in a vertical orientation. At the same time, edge 566 is sufficiently spaced below the finger and thumb stalls 20-28 so as to not interfere with a ball in the process of being caught by glove 11. In some implementations, edge 566 of netting 554 is at a height H above heel 44 of at least 1 inch. In another implementation, the height H of the netting 554 of the ball catch system 510 is within the range of 1 to 6 inches. In another implementation, the height H of the netting 554 is within the range of 1.5 to 4 inches.

Netting 554 can have a lower edge 568 that is spaced from heel 44 by distance sufficiently small such that ball 52 may not pass between edge 568 and heel 44. In some implementations, ball catch 550 may be provided by multiple individual nettings extending across the front of glove 11.

Connectors 562 and 564 are located on opposite ends of netting 554. In some implementations, connectors 562 and 564 permanently connect the ends of netting 554 to the opposite sides of glove 11. For example, in some implementations, connectors 562 and 564 may comprise stitching, welds, adhesive or the like to join the ends of netting 554 to glove 11. In implementations where netting 554 is sufficiently resiliently flexible, netting 554 may be stretched and moved from the active position shown in FIG. 8 and inactive position where netting 554 extends along a backside of glove 11 when ball catch 550 is no longer to be used. Netting 554 may be subsequently stretched and repositioned in the active position shown when desired.

In some implementations, connectors 562 and/or connector 564 releasably connected the respective ends of netting 554 to their respective sides of glove 11. For example, in some implementations, one or both of connectors 562, 564 may comprise hook and loop fastening arrangements. In yet other implementations, one or both of connectors 562, 564 may comprise quick release buckles, snaps, hooks, buttons, or other releasable connection mechanisms. In implementations where connectors 562 and 564 both releasably connect the respective ends to glove 11, netting 554 may be disconnected from glove 11 when catch 450 is no longer to be used. In some implementations, both ends of netting 554 are pivotably connected to glove by connectors 562 and 564. Netting 554 may be remounted or replaced with a netting having different characteristics when desired.

Figure 9A:
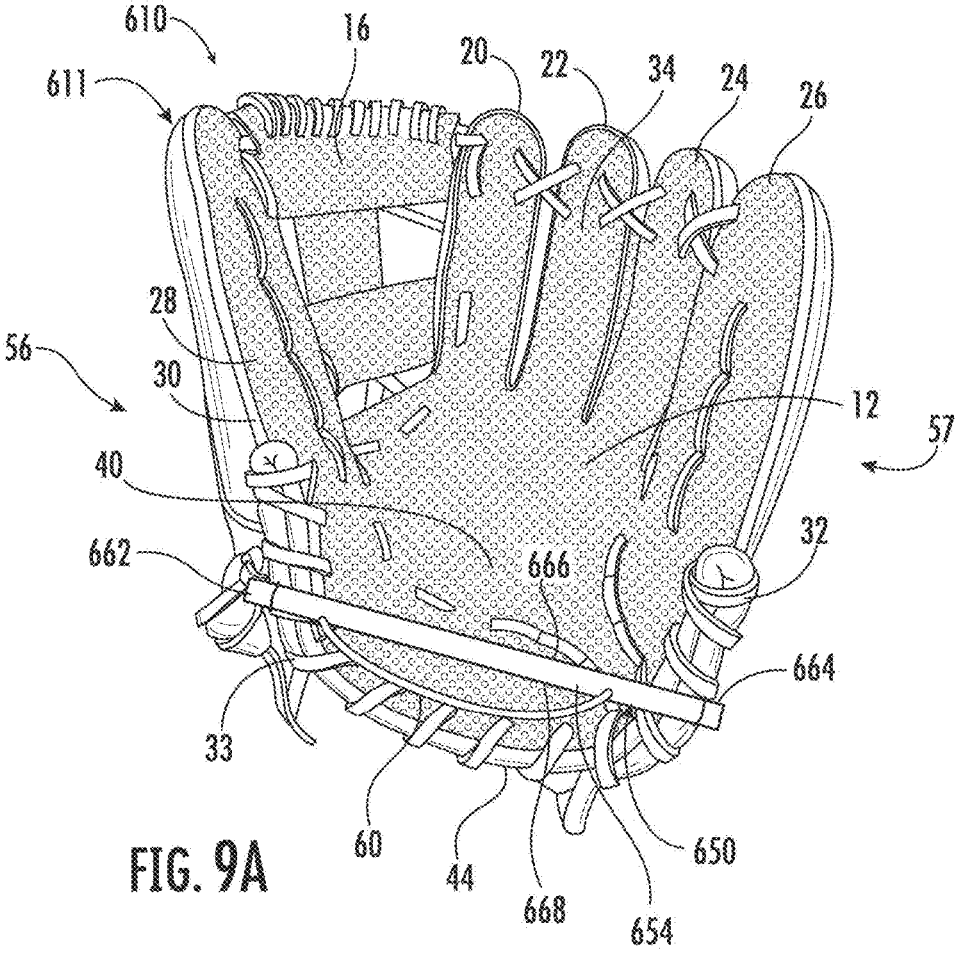
FIG. 9A is a front perspective view of an example ball glove ball catch system with an example ball catch in an active position.
Figure 9B:
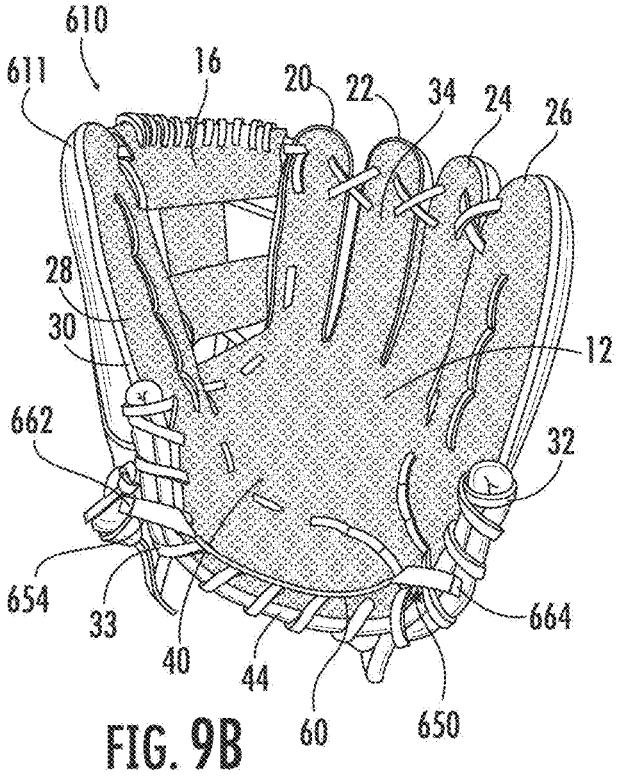
FIG. 9B is a front perspective view of the example ball glove ball catch system of FIG. 9A with the example ball catch in an inactive position.

FIGS. 9A and 9B illustrate an example ball glove ball catch system 610. FIGS. 9A and 9B illustrate an example of a ball catch and how the ball catch may be repositioned between an active state and an inactive state. System 610 comprises ball glove 611 and ball catch 650. Ball glove 611 is similar to ball glove 11 described above except that ball glove 611 additionally comprises an elongate slit or pocket 60 formed in front portion 12 proximate to 44. As will be described hereafter, pocket 60 is sized to slidably receive a portion of ball catch 650 when ball catch 650 is in an inactive position. In some implementations, pocket 60 may alternatively be formed on the backside of glove 611, wherein ball catch 650 is pivoted and/or stretched to the backside of glove 611 and inserted into pocket 60.

Ball catch 650 comprises a flexible cord or band 654 and connectors 662, 664. Band 654 spans or stretches across the front side of glove 11 from the thumb side 56 to the pinky side 57 of glove 11. Because band 654 is flexible or foldable, band 654 facilitates squeezing of the thumb side 56 and the pinky side 57 of glove 11 towards one another about a received ball 52. In some implementations, band 654 is resiliently flexible so as to remain taught during the squeezing of the thumb side 56 in the pinky side 57 of glove 11 about a received ball.

Band 654 has a top edge 666 that is elevated above heel 44 at a height sufficient to retain a caught ball at least partially within pocket 40 when glove 11 is in a vertical orientation. At the same time, top edge 666 is sufficiently spaced below the finger and thumb stalls 20-28 so as to not interfere with a ball in the process of being caught by glove 11. In some implementations, top edge 666 is at a height H above heel 44 of at least of 1 inch. In another implementation, the height H of the top edge 666 can be within the range of 1 to 6 inches. In another implementation, the height H of the top edge 666 can be within the range of 1.5 to 4 inches.

Band 654 has a lower edge 668 that is spaced from heel 44 by distance sufficiently small such that ball may not pass between edge 668 and heel 44. In some implementations, ball catch 650 may be formed by multiple individual bands similar to ball catch 450 described above. In some implementations, ball catch 650 may comprise a netting similar to ball catch 550 described above.

Connectors 662 and 664 (schematically illustrated) are located on opposite ends of band 654. In some implementations, connectors 662 and 664 permanently connect the ends of band 654 to the opposite sides of glove 11. For example, in some implementations, connectors 462 and 464 may comprise stitching, welds, adhesive or the like to join the ends of band 654 to glove 11.

In some implementations, connectors 662 and/or connector 664 releasably connect the respective ends of band 654 to their respective sides of glove 11. For example, in some implementations, one or both of connectors 662, 664 may comprise hook and loop fastening arrangements. In yet other implementations, one or both of connectors 662, 664 may comprise quick release buckles, snaps, hooks, buttons, or other releasable connection mechanisms. In implementations where connectors 662 and 664 both releasably connect the respective ends to glove 11, band 654 may be disconnected from glove 11 when catch 650 is no longer to be used. Band 654 may be remounted when desired.

As shown by FIG. 9B, when a player no longer wishes to use ball catch 650, band 654 may be moved to an inactive position by being stretched and slid into or inserted into pocket 60. In some implementations, the resilient material forming band 654 resiliently returns towards a linear state, retaining band 654 within pocket 60. In some implementations, pocket 60 may be additionally provided with a closing mechanism. For example, in some implementations, pocket 60 may be selectively opened and closed using a zipper. In some implementations, pocket 60 may be retained in a closed position using a hook and loop fastener arrangement. In some implementations, 650 may be disconnected from glove 11 and completely inserted into pocket 60 when not being used. In yet other implementations, glove 611 may provide with a pocket at other locations, such as long a backside of glove 611, wherein the pocket may receive band 654 while band 654 remains connected via connector 662 and 664 or may receive band 654 after it has been completely disconnected from glove 611.

Figure 10:
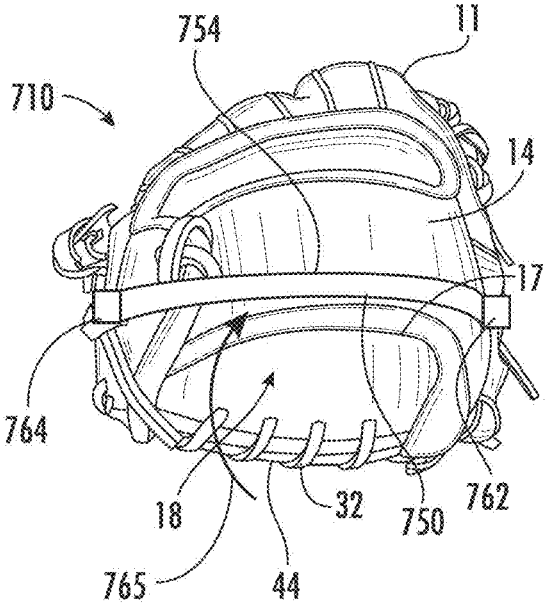
FIG. 10 is a rear perspective view of an example ball glove ball catch system with an example ball catch in an inactive position.

FIG. 10 illustrates an example ball glove ball catch system 710. FIG. 10 illustrates an example of how an example ball catch may be stretched and repositioned in an inactive position behind a ball glove, or on the back portion or the backside of the ball glove. System 710 comprises ball glove 11, the backside of which is shown in FIG. 10, and ball catch 750. Ball catch 750 is dimensioned similar to ball catch 650 described above. Ball catch 750 comprises a band 754 connected to opposite sides of glove 11 by connectors 762 and 764. Band 754 is sufficiently resiliently flexible so as to be stretched and moved about heel 44 in the direction indicated by arrow 765 from an active position in which band 754 spans across the front of ball glove 11 between the thumb side and pinky side of ball glove 11 (similar to the active position of band 654 in FIG. 9A), to the inactive position shown in FIG. 10 in which band 754 is stretched about a backside of ball glove 11. In the example illustrated, connectors 762 and 764 permanently connect band 754 to glove 11 by stitching, adhesives, welds, rivets, pivot posts or the like. In some implementations, connectors 762 and 764 are configured such that band 754 may pivot about posts of both of connectors 762 and 764 from the active position on the front of glove 11 to the inactive position on the back side of glove 11, with or without band 754 being stretchable. In other implementations, connectors 762 and 764 may releasably connect ends of band 754 to glove 11.

FIGS. 11-15 illustrate an example ball glove ball catch system 810. FIGS. 11-15 illustrate an example ball catch and how the example ball catch may be moved between an active position and an inactive position. System 810 comprises a ball glove 811 and a ball catch 850. Ball glove 811 is similar to ball glove 11 described above except that ball glove 811 additionally comprises ball catch inactive position retainer 80 (shown in FIG. 12). The remaining components of ball glove 11 which correspond to components of ball glove 11 are numbered similarly.

Figure 13:
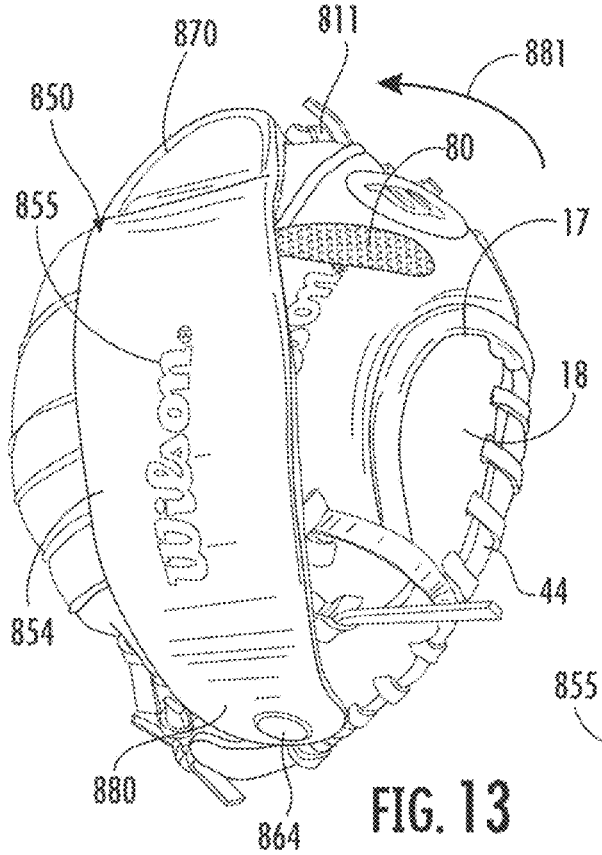
FIG. 13 is a bottom perspective view of the example ball glove ball catch system of FIG. 11 with the example ball catch moved to an inactive position.
Figure 14:
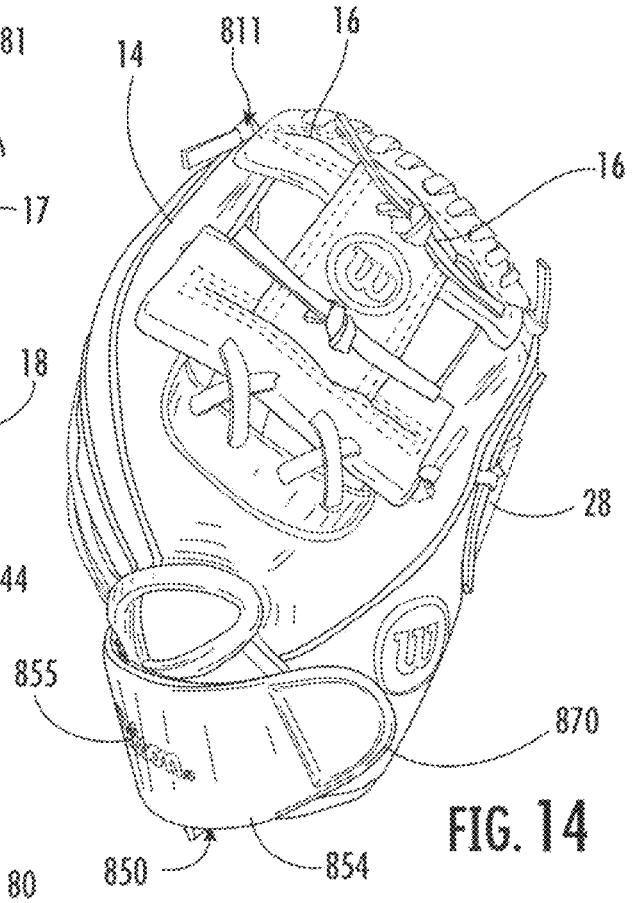
FIG. 14 is a rear perspective view of the example ball glove ball catch system of FIG. 11 with the example ball catch retained in the inactive position.
Figure 15:
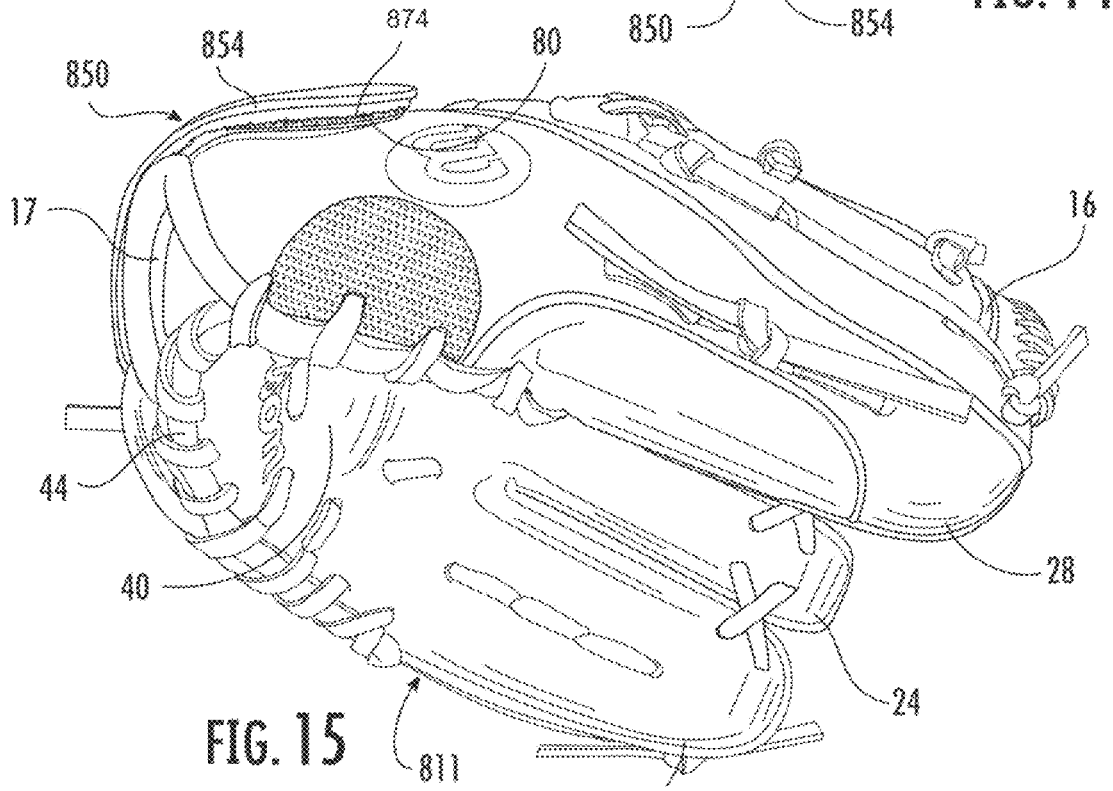
FIG. 15 is a side perspective view of the example ball glove ball catch system of FIG. 14 with the example ball catch retained in the inactive position.

Ball glove inactive position retainer 80 secures ball catch 850 in the inactive position shown in FIGS. 13-15. In the example illustrated, retainer 80 comprises a first portion of a hook and loop fastener arrangement that connects to a second portion of the hook and loop fastener arrangement which is provided on an end of ball catch 850. In other implementations, retainer 80 may comprise other structures for releasably retaining ball catch 850 in the inactive position. For example, retainer 80 may comprise a quick release buckle, a snap, a button, a hook or a strap or loop that wraps about an end portion of ball catch 850 when ball catch 850 is in the inactive position.

Figure 11:
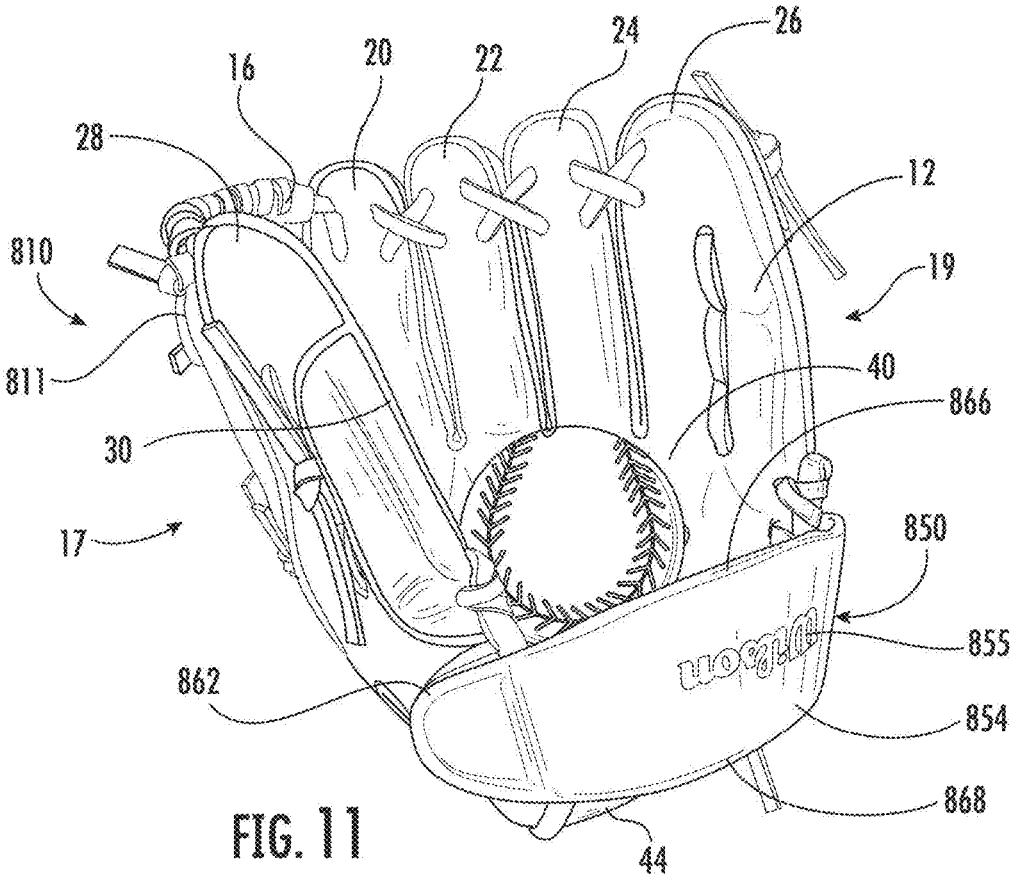
FIG. 11 is a front perspective view of an example ball glove ball catch system with an example ball catch in an active position.

Ball catch 850 comprises a flexible band 854 and connectors 862, 864 (shown in FIG. 13). As shown by FIG. 11, in the active position, band 854 spans or stretches across the front side of glove 811 from the thumb side 56 to the pinky side 57 of glove 11. As further shown by FIG. 11, when in the active position, band 854 forms an upright wall having an upper edge that is below the webbing 16 (shown in FIG. 14), towards the hand opening 17, along the ball receiving front face. In the active position shown in FIG. 11, the band 854 has a midpoint between the ends of band 854 that extends across the ball receiving front side of the glove 810. Because band 854 is flexible or foldable, band 854 facilitates squeezing of the thumb side 56 and the pinky side 57 of glove 11 towards one another about a received ball 52. In the example illustrated, band 854 is imperforate and is formed from a layer or multiple layers of thermoplastic material. In other implementations, the band 854 can also have a layer of felt or fabric to facilitate the retention of the received ball 52. In other implementations, band 854 is perforate and/or is resiliently flexible so as to remain taught during the initial squeezing of the thumb side 56 and the pinky side 57 of glove 11 about a received ball.

Band 854 has a top edge 866 that is elevated above heel 44 at a height sufficient to retain a caught ball at least partially within pocket 40 when glove 11 is in a vertical orientation. At the same time, top edge 866 is sufficiently spaced below the finger and thumb stalls 20-28 so as to not interfere with a ball in the process of being caught by glove 11. In some implementations, top edge 866 is at a height H above heel 44 of at least of at least of 1 inch. In another implementation, the height H of the top edge 866 can be within the range of 1 to 6 inches. In another implementation, the height H of the top edge 866 can be within the range of 1.5 to 4 inches.

Band 854 has a lower edge 868 that is spaced from heel 44 or that overlaps heel 44 such that ball may not pass between edge 868 and heel 44. In some implementations, ball catch 850 may be formed by multiple individual bands similar to ball catch 450 described above. In some implementations, ball catch 850 may comprise a netting similar to ball catch 550 described above.

Connector 862 is provided on the backside of glove 811 and on end portion 870 of band 854. Connector 862 releasably connects end portion 870 of band 854 to the thumb side 56 of glove 11. In the example illustrated, connector 862 comprises a hook and loop fastener arrangement having a first portion 872 of the hook and loop faster formed upon or connected to glove 811 generally between heel 44 and thumb stall 28 along the thumb side 56 of glove 11. The hook and loop fastener arrangement forming connector 862 has the second portion 874 of the hook and loop fastener formed upon or connected to end portion 870 of band 854. In the example illustrated, portion 874 is configured to connect to retainer 80, wherein retainer 80 comprises the first portion of the hook and loop fastener similar to portion 872.

In other implementations, connector 862 may comprise other releasable mounting mechanisms. For example, in other implementations, portions 872 and 874 may comprise portions of a quick release buckle, may comprise a ring and a hook, may comprise a buttonhole and a button, one or more snaps, other fastening mechanisms and combinations thereof. In some implementations, the portion of the connector 862 provided on band 854 is also configured to connect to retainer 80.

Connector 864 (shown in FIG. 13) is provided on the backside of glove 811 between heel 44 and the pinky stall 26 of glove 811. Connector 864 pivotally connects a second end portion 880 of band 854 to glove 11. In the example illustrated, connector 864 comprises a rivet or post that passes through band 854 and portions of glove 811, wherein band 854 may pivot about the post. In some implementations, connector 864 provides a permanent connection between band 854 and glove 11. In yet other implementations, connector 864 comprises a snap or other mechanism which facilitates disconnection of end portion 880 from glove 811.

Figure 12:
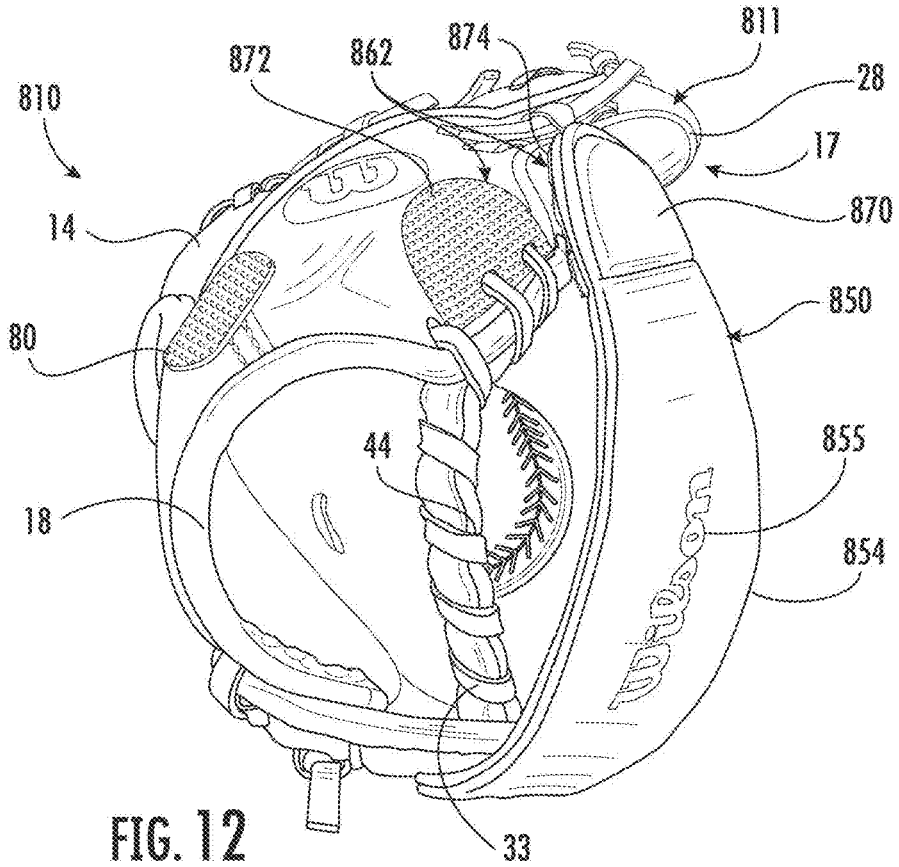
FIG. 12 is a bottom perspective view of the example ball glove ball catch system of FIG. 11 with the example ball catch partially disconnected from a ball glove.

As shown by FIG. 12, when a player no longer wishes to use ball catch 850, end portion 870 of band 854 may be disconnected by separating portions 872 and 874 of connector 862. As shown by FIG. 12, the glove connector in the form of portion 872 and the glove connector in the form of retainer 80 are each formed by distinct patches of portions of hook and loop fasteners, wherein the patches are spaced by a region of the backside of the glove omitting any portion of a hook and loop fastener. In the example illustrated, portion 872 extends adjacent to and vertically below the thumb stall, along and adjacent to an edge of the glove joining the ball receiving front side of the glove to the backside of the glove from the thumb stall to the hand opening. As shown by FIG. 13 and as indicated by arrow 881, band 854 may be pivoted about the axis of connector 864, around heel 44, and to a backside of glove 811. As shown by FIGS. 14 and 15, end portion 870 of band 854 may be releasably secured to the backside of glove 811 in an inactive position by connecting portion 874 of connector 862 (carried by band 854) to retainer 80 on the backside of glove 811. In the inactive position, the midpoint of band 854 is located and extends across the backside of ball glove 810. As shown by FIG. 15, the back side of glove 810 has a curvature and the band connector in the form of portion 874 is secured to the glove connector in the form of retainer 80 such that band 854 is retained in a curved shape corresponding to the curvature of the backside of the glove. As shown by FIG. 15, in the inactive position, the band 854 has a lower edge adjacent to and along the hand opening 17. Conversely, when the player once again desires to use ball catch 850, the reverse procedure may be carried out. The band 854 can include alphanumeric and/or graphical indicia 855. The indicia 855 can take the form of a trademark, a design, a warning, instructional information, a player name, a team name, and combinations thereof.

Figure 16:
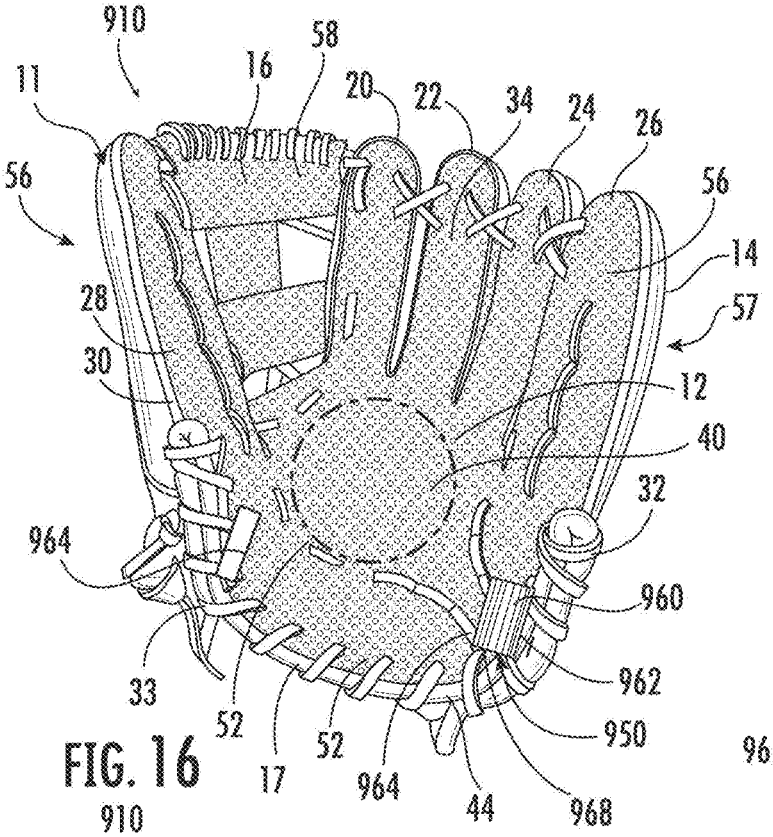
FIG. 16 is a front perspective view of an example ball glove ball catch system in an inactive or retracted state.
Figure 18:
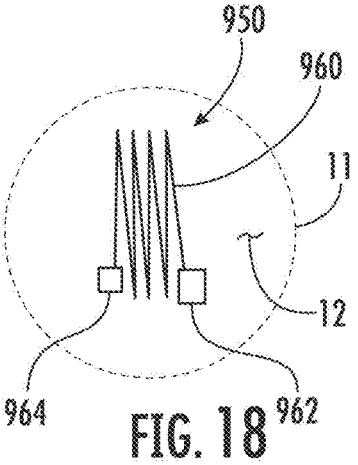
FIG. 18 is an enlarged fragmentary view of the ball catch system of FIG. 16.
Figure 17:
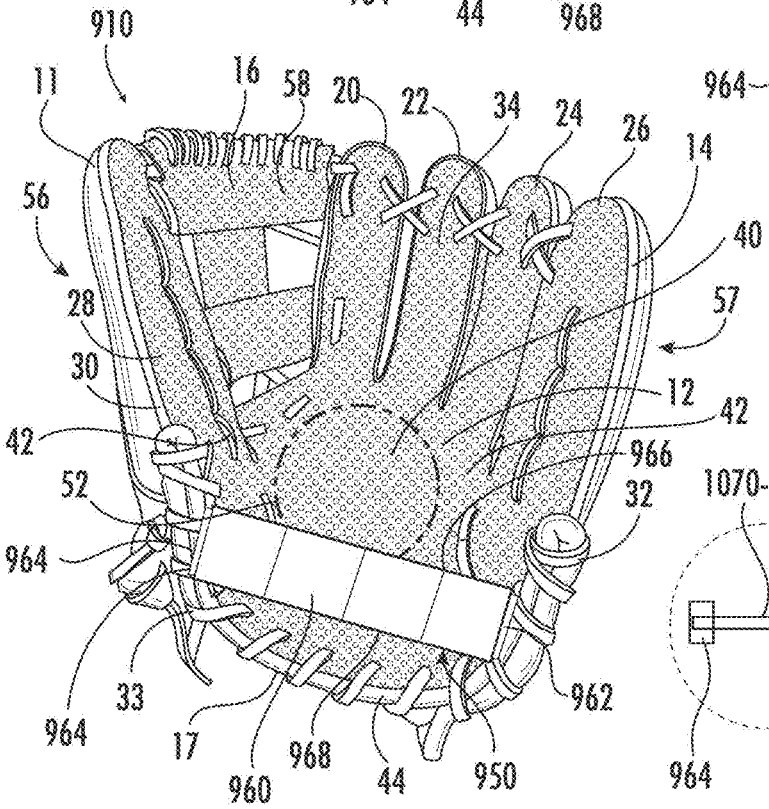
FIG. 17 a front perspective view of the example ball glove catch system of FIG. 16 in an active or extended state.

FIGS. 16-18 illustrate an example ball glove ball catch system 910. FIGS. 16-18 illustrate an example of a ball catch in the form of a foldable, or accordion-like ball catch. System 910 comprises ball glove 11 (described above) and ball catch 950. Ball catch 950 comprises folded wall 960 and connectors 962, 964.

Foldable wall 960 comprises a perforate or imperforate foldable member that spans or stretches across the front side of the front portion 12 of glove 11 from the thumb side 56 to the pinky side 57 of glove 11. Foldable wall 960 is flexible, permitting the thumb side 56 and the pinky side 57 of glove 11 to be squeezed towards one another about a received ball 52.

Folding wall 960 has a top edge 966 that is elevated above heel 44 at a height sufficient to retain a caught ball 52 at least partially within pocket 40 when glove 11 is in a vertical orientation. At the same time, edge 966 is sufficiently spaced below the finger and thumb stalls 20-28 so as to not interfere with a ball in the process of being caught by glove 11. Foldable wall 960 can have a lower edge 968 that is spaced from heel 44 by distance sufficiently small such that ball 52 may not pass between edge 968 and heel 44.

Connectors 962 and 964 are located on opposite ends of foldable wall 960. In some implementations, connectors 962 and 964 permanently connect the ends of foldable wall 960 to the opposite sides of glove 11. For example, in some implementations, connectors 962 and 964 may comprise stitching, welds, adhesive or the like to join the ends of foldable wall 960 to glove 11. In such an implementation, such folds facilitate the closing of glove 11 about a ball or the opening of glove 11 to accommodate catching a ball In some implementations, connectors 962 and/or connector 964 releasably connected the respective ends of wall 960 to their respective sides of glove 11. For example, in some implementations, one or both of connectors 962, 964 may comprise hook and loop fastening arrangements. In yet other implementations, one or both of connectors 962, 964 may comprise quick release buckles, snaps, hooks, buttons, or other releasable connection mechanisms. In implementations where connectors 962 and 964 both releasably connect the respective ends to glove 11, wall 960 may be disconnected from glove 11 when catch 950 is no longer to be used. In some implementations, both ends of wall 960 are pivotably connected to glove by connectors 462 and 464. Wall 960 may be remounted or replaced with a foldable wall 960 having different characteristics when desired.

Figure 19:
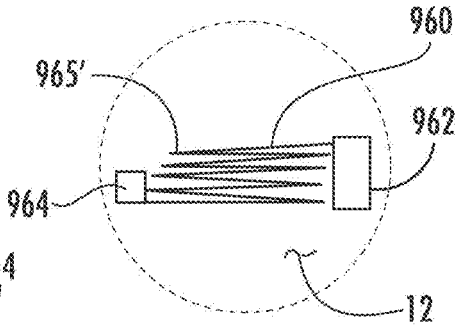
FIG. 19 is enlarged fragmentary view of the ball glove of FIG. 16 with an alternative ball catch.

FIGS. 16 and 18 illustrate catch 950 and foldable wall 960 in a retracted or folded state. As shown by FIG. 18, each folded section or panel of wall 960 is folded such that the individual folded panels overlap one another in a direction extending along an axis that extends from thumb side 56 to pinky side 57. As shown by FIG. 19, in other implementations, folded wall 960 may be folded at an angle 90 degrees offset from that shown in FIG. 18 such that the individual folded panels overlap one another in a direction extending from the heel 44 to the fingertips of glove 11.

FIG. 17 illustrates an example wherein connector 964 releasably connects foldable wall 960 to glove 11, facilitating the complete retraction of foldable wall 960 as shown in FIG. 16. In the extended state, wall 960 serves to retain a ball caught within pocket 40 of glove 11, to retain a ball between heel 44 and webbing 16. When catch 950 is to no longer be used, connector 960 may be disconnected (for example, a button may be released, a snap may be released, or hooks may be released from loops of a hook and loop fastener arrangement), facilitating the repositioning of ball catch 950 to the retracted state as shown by FIG. 16.

Figure 20:
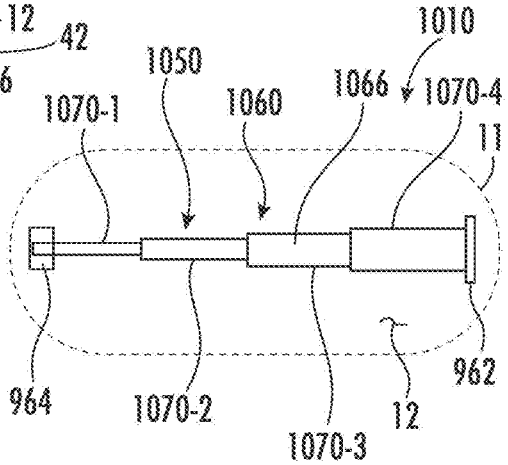
FIG. 20 is an enlarged fragmentary view of the ball glove of FIG. 16 with an alternative ball catch.

FIG. 20 is an enlarged fragmentary view illustrating portions of an example ball catch system 1010. FIG. 20 illustrates an example of a ball catch in the form of a telescopic ball catch, while in an extended state. System 1010 comprises ball glove 11 (described above) and ball catch 1050. Ball catch 1050 comprises a telescopic wall 1060 and connectors 962, 964 (described above).

Telescopic wall 1060 comprises an expandable internested arrangement of panels that span or stretch across the front side of the front portion 12 of glove 11 from the thumb side 56 to the pinky side 57 of glove 11. Telescopic wall 1060 is flexible, permitting the thumb side 56 and the pinky side 57 of glove 11 to be squeezed towards one another about a received ball 52. To move telescopic 1060 to a retracted state, such as when ball catch 1050 is not to be used, panel 1070-1 may be disconnected at connector 964 and may be slid or telescoped into panel 1070-2. Likewise, panel 1070-2 may be telescoped into panel 1070-3. Panel 1070-3 may be telescoped into panel 1070-4. Although telescopic wall 1060 is illustrated as having four telescopic panels 1070, in other implementations, telescopic wall 1060 may have a greater or fewer of such telescopic sections or panels.

Telescopic wall 1060 has a top edge 1066 that is elevated above heel 44 at a height sufficient to retain a caught ball 52 at least partially within pocket 40 when glove 11 is in a vertical orientation. At the same time, edge 1066 is sufficiently spaced below the finger and thumb stalls 20-28 so as to not interfere with a ball in the process of being caught by glove 11. Telescopic wall 1060 can have a lower edge that is spaced from heel 44 by distance sufficiently small such that ball 52 may not pass between the lower edge 968 and heel 44.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A ball glove ball catch system comprising:

a ball glove comprising a webbing and a hand opening; and a ball catch between the hand opening and the webbing, wherein the ball glove comprises a front portion forming a pocket, a thumb stall, a series of finger stalls comprising a distant finger stall most distant from the thumb stall, wherein the webbing is between the thumb stall and the series of finger stalls, wherein the ball catch comprises a band extending across a ball receiving front side of the ball glove, from the thumb stall to the distant finger stall, the band having a first end portion having a first band connector, a second end portion having a second band connector, and a midpoint between the first end portion and the second end portion, and wherein the band has (1) an active position in which the band is coupled to the ball glove while the midpoint extends across the ball receiving front side of the ball glove and in which the band forms an upright wall having a height of at least 1 inch, the upright wall having an upper edge, the upper edge being below the webbing, towards the hand opening, along the ball receiving front side, below the pocket to retain a ball within the pocket and (2) an inactive position in which the band is coupled to the ball glove by each of the first band connector and the second band connector while the midpoint extends across a backside of the ball glove;

wherein the band is movable relative to the glove between the active and the inactive position.

2. The system of claim 1, wherein at least one of the first and second end portions is releasably connected to the ball glove.

3. The system of claim 1, wherein the band is perforate.

4. The system of claim 1, wherein the band is pivotable between the active position and the inactive position while the first end portion remains attached to the ball glove.

5. The system of claim 1, wherein the first band connector and the second band connector are releasably coupled to the ball glove.

6. The system of claim 1, wherein the ball glove comprises a first glove connector for releasable coupling to the second band connector of the band when the band is in the inactive position, and a second glove connector for releasable coupling to the second band connector of the band when the band is in the active position.

7. The system of claim 6, wherein the first and second glove connectors are positioned on the backside of the ball glove.

8. The system of claim 1, wherein the backside of the glove comprises a pivot connector pivotably connected to the second end portion of the band for pivoting of the band about the pivot connector between the inactive position and the active position, the pivot connector providing a permanent connection between the band and the ball glove.

9. The system of claim 1, wherein the ball glove comprises a post and wherein the band is pivotable about the post between the active position and the inactive position.

10. The system of claim 1, wherein the band, when in the inactive position, is entirely located and carried on the backside of the ball glove.

11. The system of claim 1, wherein the backside of the glove has a curvature between the thumb stall and the distant finger stall most distant the thumb stall, wherein the ball glove comprises a first glove connector and a second glove connector for connection to the first band connector and the second band connector, respectively, and wherein the first band connector and the first glove connector are located and spaced to retain the band in a curved shape corresponding to the curvature when the band is in the inactive position.

12. The system of claim 11, wherein the first glove connector comprises a first patch of a portion of a hook and loop fastener and wherein the second glove connector comprises a second patch of a portion of a hook and loop fastener, and wherein the first patch and the second patch are separated and spaced by a region of the backside of the glove omitting any portion of a hook and loop fastener.

13. The system of claim 1, wherein the ball glove comprises a first glove connector and a second glove connector for connection to the first band connector and the second band connector, respectively, and wherein the second glove connector extends adjacent to and vertically below the thumb stall, the second glove connector extending along and adjacent to an edge of the glove joining the ball receiving front side of the glove and the backside of the glove and extending from the thumb stall to the hand opening.

14. The system of claim 1, wherein the band has a lower edge and wherein the lower edge extends adjacent to and along the hand opening when the band is in the inactive position.

15. The system of claim 1, wherein the glove comprises a heel along the hand opening and wherein the band is pivotable from the active position, around the heel, to the inactive position.

* * * * *